United States Patent [19]

Baird et al.

[11] Patent Number: 4,527,623

[45] Date of Patent: Jul. 9, 1985

[54] KINETICALLY BONDED TUBES AND TUBESHEET

[75] Inventors: Richard H. Baird; Theodore J. Blechar; Leo V. B. Giladett, all of Santa Cruz; Reginald M. Horner, Watsonville; Gerald G. Prouty, Santa Cruz; David L. Rinde, Boulder Creek, all of Calif.

[73] Assignee: Electric Power Research Institute, Inc., Palo Alto, Calif.

[21] Appl. No.: 332,924

[22] Filed: Dec. 21, 1981

[51] Int. Cl.[3] ..... B23K 20/08

[52] U.S. Cl. ..... 165/173; 228/2.5; 228/109; 228/183; 138/89

[58] Field of Search ..... 228/2.5, 107, 108, 109, 228/183; 138/89; 102/274.5, 275.7, 275.12; 29/421 E; 165/173, 178

[56] References Cited

U.S. PATENT DOCUMENTS

| | | | |
|---|---|---|---|
| 1,652,961 | 12/1927 | Snelling | 102/275.7 |
| 3,078,551 | 2/1963 | Patriarea et al. | 228/183 X |
| 3,397,444 | 8/1968 | Bergmann et al. | |
| 3,402,870 | 9/1968 | Carlson et al. | |
| 3,409,969 | 11/1968 | Simons et al. | 29/421 E X |
| 3,426,681 | 2/1969 | Oliver | 29/421 E X |
| 3,503,110 | 3/1970 | Berry et al. | 29/157.4 |
| 3,672,035 | 6/1972 | Lieberman | 29/421 |
| 3,698,067 | 10/1972 | Feiss | 228/107 |
| 3,868,131 | 2/1975 | Zondag | 228/7 X |
| 3,939,681 | 2/1976 | Yoshitomi et al. | 29/421 E X |
| 3,993,001 | 11/1976 | Hawes | 228/2.5 X |
| 4,003,513 | 1/1977 | Chadwick | |
| 4,117,966 | 10/1978 | Green et al. | 228/2.5 |

FOREIGN PATENT DOCUMENTS

| | | | |
|---|---|---|---|
| 2295813 | 7/1976 | France | 228/107 |

OTHER PUBLICATIONS

Williams et al., "Paper No. 37" *Advances in Welding Processes—Third International Conf.,* Harrogate 1974, pp. 249-262.

Crossland et al., Proceedings 2nd Int'l Conf. on Pressure Vessel Technology; Part II, Oct. 1973, pp. 1131-1149.

*Primary Examiner*—Kenneth J. Ramsey

*Attorney, Agent, or Firm*—John J. Morrissey

[57] ABSTRACT

An exterior surface portion of a metal tube (30) is bonded to a surface portion of a bore (11) in a metal tubesheet (10) by detonating an explosive bonding charge (31) inside the tube (30) adjacent a front face (13) of the tubesheet (10). The bonding charge (31) consists of nitroguanidine, and is contained within a polypropylene container comprising a cup structure (21) and a header structure (22). The cup structure (21) forms a receptacle for the bonding charge (31), and positions the bonding charge (31) at the proper depth within the tube (30) to achieve the desired bonding effect. The header structure (22) overlies and shapes the bonding charge (31), and contains a transfer charge (44) and a firing charge (45) for initiating detonation of the bonding charge (31). A firing assembly for initiating detonations of firing charges (45) in tubes (30) arranged in a plurality of linear arrays comprises a corresponding plurality of firing rails (24) and an initiation rail (27). Each firing rail (24) is secured to the header structures (22) of a corresponding linear array of bonding charge containers, so that a linear charge (25) secured to the firing rail (24) can initiate detonation in sequence of the individual firing charges (25) of the corresponding linear array. An initiation rail (27) crosses each of the firing rails (24), so that a linear initiation charge (26) secured to the initiation rail (27) can detonate each of the linear charges (25) on the various firing rails (24) in sequence.

98 Claims, 12 Drawing Figures

KINETICALLY BONDED TUBES AND TUBESHEET

BACKGROUND OF THE INVENTION (1) Technical Field

This invention relates to kinetic bonding of metal tubes to a metal tubesheet.

(2) Description of the Prior Art

The bonding of metal tubes to a metal tubesheet is an essential procedure in fabricating many types of heat exchangers. In steam condensers of the surface type, which is the type of heat exchanger most often used in systems for generating electric power from fossil fuel, geothermal and nuclear energy sources, the quality of the bond between tubes and a tubesheet is especially important. A steam condenser of the surface type is a heat exchanger in which cooling water is circulated through tubes whose exterior surfaces are exposed to steam that is to be condensed.

Bond failure between tubes and a tubesheet in any type of heat exchanger, particularly in a steam condenser used in an electric power generating system, could result in costly damage to equipment and costly downtime. Regardless of the application or operating environment of the heat exchanger, high-quality bonding between the tubes and the tubesheet is of considerable importance in minimizing corrosion.

Conventional welding techniques for bonding a plurality of individual tubes to a tubesheet are quite time consuming. Furthermore, conventional welding techniques in general cannot be used for bonding tubes to tubesheets that are made of dissimilar metals. Consequently, techniques for explosively bonding tubes to tubesheets have been developed. Various techniques for explosively bonding individual metal tubes to a metal tubesheet have been described in the patent literature: e.g., U.S. Pat. Nos. 3,503,110; 3,698,067; 3,717,925; 3,774,291; 3,993,001; 4,003,513; 4,117,966; and 4,205,422. A technique was also described in U.S. Pat. No. 3,993,001 for bonding an array of tubes to a tubesheet in a single operation by initiating simultaneous detonations of explosive charges in all the tubes of the array.

With some kinetic bonding techniques in which explosive charges were detonated inside tubes positioned in bores through a tubesheet, crevices tended to be formed at the front face of the tubesheet between the exterior surfaces of the tubes and the surrounding surfaces of the bores. Such crevices were potential sites for corrosion, which could weaken and ultimately cause failure of the bonds. An expedient developed by Westinghouse Electric Corporation to minimize front face crevicing involved securing a disposable metal plate fixture over the front face of the tubesheet during detonation of the explosive charges. Such an expedient, however, introduced the problem of controlling tolerances in manufacturing the disposable metal fixturing.

A need has existed in the prior art for a highly reliable explosive bonding technique for metallurgically bonding an array of tubes to a tubesheet at a high rate of production appropriate for commercial manufacturing operations without causing appreciable crevicing at the front face of the tubesheet.

SUMMARY OF THE INVENTION (1) Statement of Objects:

It is an object of the present invention to provide a highly reliable technique for metallurgically bonding an array of metal tubes to a metal tubesheet as a step in the fabrication of a heat exchanger device such as a steam condenser.

It is more particularly an object of the present invention to provide a technique whereby metal tubes positioned in an array of bores in a metal tubesheet can be kinetically bonded to the tubesheet by detonating explosive charges in the tubes without causing any appreciable crevicing at the front face of the tubesheet. A concomitant object of the present invention is to provide an explosive bonding technique for metallurgically bonding metal tubes to a metal tubesheet while causing only slight bulging of the tubes adjacent the rear face of the tubesheet, thereby achieving a swaging of the tubes to the tubesheet adjacent the rear face of the tubesheet so as to minimize the occurrence of rear face (i.e., "steamside") crevicing.

It is a further object of the present invention to provide apparatus for implementing a kinetic bonding process in which a plurality of metal tubes positioned in corresponding bores in a metal tubesheet are metallurgically bonded to the tubesheet, with the bond formed between each tube and the surface of the corresponding bore through the tubesheet being strongest adjacent the front face of the tubesheet.

A kinetic bonding apparatus in accordance with the present invention includes a novel explosive package for insertion into a tube that is positioned in a tubesheet bore in such a way that an annular gap (demoninated a "fly distance") exists between the tube and the surface of the bore adjacent the front face of the tubesheet. The explosive package of the present invention enables a specially shaped bonding charge to be located within the tube so that forces resulting from detonation of the bonding charge cause a portion of the tube adjacent the front face of the tubesheet to move outwardly toward the bore, and to impact upon the surface of the bore with sufficient kinetic energy to cause welding of an exterior surface portion of the tube to the surrounding surface of the bore.

The shape of the bonding charge and the location of the bonding charge within the tube are selected so as to cause the resulting bond formed between the tube and the surface of the tubesheet bore, upon detonation of the bonding charge, to be strongest adjacent the front face of the tubesheet. Another factor in selecting the location of the bonding charge within the tube, i.e., in determining the depth to which the bonding charge is inserted into the tube, is the desirability of producing a very slight bulging of the tube at the rear face of the tubesheet in order to minimize the occurrence of steamside crevicing. The actual shape of the bonding charge and the position of the bonding charge in the tube are tailored to the structural characteristics and dimensions of the particular tube and tubesheet.

A kinetic bonding apparatus in accordance with the present invention also includes a novel firing assembly for initiating detonations of individual bonding charges contained in corresponding explosive packages, which are inserted into corresponding tubes to be bonded to the surfaces of corresponding tubesheet bores. The firing assembly of the present invention is designed so that detonations of bonding charges in adjacent tubes can occur for the most part only at temporally spaced intervals.

The individual bonding charges of the present invention are detonated by the firing assembly in a planned temporal pattern that precludes simultaneous bonding charge detonations in adjacent tubes as far as possible. Simultaneity of the detonations of bonding charges in adjacent tubes, which was favored in the prior art, occurs only randomly in the present invention as the result of accumulations of manufacturing tolerances and explosive charge inhomogeneities. Accordingly, the occurrence of simultaneous bonding charge detonations in adjacent tubes can be controlled to whatever extent is deemed practicable by applying appropriate conventional quality control standards to the manufacture of the apparatus and the explosive materials used in practicing the invention.

The present invention is particularly applicable where the tubesheet bores in which the tubes are positioned are closely spaced with respect to each other. In accordance with current design practice for steam condensers, the minimum spacing allowed between adjacent bore centers (i.e., between adjacent tube centers for tubes positioned concentrically within the bores) is only 1.2 times the outside diameter of the tubes. A major adverse effect of simultaneous bonding charge detonations in adjacent closely spaced tubes is crystallographic deformation (denominated "spalling") of the tubesheet portion (denominated the "ligament") between the adjacent bores. Spalling of the ligament is most pronounced where the distance between adjacent bores is at the design minimum. With the present invention, a metallurgical bond can be formed without significant liqament spalling where the ligament width is as narrow as standard steam condenser design practice presently allows.

The bonding charge detonation pattern of the present invention, by minimizing the occurrence of simultaneous bonding charge detonations in adjacent tubes, minimizes the possibility of damage to a tubesheet ligament from combined shock waves produced by detonations of bonding charges in tubes positioned in adjacent bores of the tubesheet. The firing assembly for obtaining the desired bonding charge detonation pattern provides that detonations in adjacent tubes are separated by a time interval, which is sufficiently long to prevent the adverse effects of simultaneous detonations but not long enough to permit the bore surface surrounding any unbonded tube to move in reaction to the detonation of a bonding charge in an adjacent tube.

Where the distance between adjacent bores in a tubesheet is small, the detonation of an explosive bonding charge in a tube positioned in a given bore of the tubesheet would tend to cause the surface of that given bore to expand (i.e., to move radially outward). Unless the bonding charges in tubes positioned in bores adjacent the given bore are detonated before the surface of the given bore has had time to move, the surface of the given bore would move and cause concomitant movement of the surfaces of the adjacent bores in which bonding charges have not yet been detonated. Movement of the surfaces of the adjacent bores would result in encroachment by the tubesheet ligaments upon the annular gaps (i.e., the fly distances) around the tubes in the adjacent bores. Such encroachment by the tubesheet ligaments upon the fly distances around the tubes in the adjacent bores would lessen the kinetic energy with which those tubes could impact upon the surrounding bore surfaces when the bonding charges in those tubes in the adjacent bores are subsequently detonated.

The firing assembly of the present invention provides a specific "time window" for the bonding charge detonation occurring in each tube of a plurality of adjacent tubes. The specific time window for each tube is sufficiently "wide" that simultaneous detonations of the bonding charges in adjacent tubes are prevented as far as possible, within manufacturing limitations imposed by the accumulation of manufacturing tolerances and explosive charge inhomogeneities. The time window is also sufficiently "narrow" that detonation of the bonding charge in any given tube occurs before the surface of the bore surrounding the given tube can move in reaction to previous detonations of bonding charges in adjacent tubes.

It is a feature of the present invention that only secondary explosives are used in the firing assembly, as well as in the explosive packages that are inserted into the tubes to be bonded to the tubesheet. Primary explosives are not used, thereby eliminating the substantial safety risk inherent in the use of primary explosives. The preferred explosive material for the bonding charge is nitroguanidine.

It is also a feature of the present invention that the bonding charge in each explosive package is housed in a container comprising molded plastic components made of a chemically stable material that does not produce toxic vapors when the bonding charge is detonated. Furthermore, the material of which each container is made does not produce debris that would clog the tube when the bonding charge is detonated. Preferably, the container is made of polypropylene.

Another feature of the present invention is the explosive package configuration. Each explosive package has a hexagonal portion that, when the explosive package is inserted into its corresponding tube, overlaps the edge of the front face of the tubesheet circumjacent the bore in which the corresponding tube is positioned. The hexagonal portions of the various explosive packages overlapping the various bore edges of the front face of the tubesheet all nest together to form a protective covering for the front face of the tubesheet in the vicinity of the bores.

(2) Nature, Operation and Purpose of the Invention:

In practicing the present invention to fabricate a heat exchanger, metal tubes are positioned in corresponding bores in a metal tubesheet. Ordinarily, the bores are arranged in a rectangular distribution of parallel linear arrays on the tubesheet, although the invention is not dependent upon the geometrical distribution of the bores. Each bore is dimensioned to provide a "fly distance" adjacent the front face of the tubesheet between the exterior surface of the tube positioned therein and the surface of the surrounding bore. The bore is reduced in diameter adjacent the rear face of the tubesheet in order to provide a clearance fit between the exterior surface of the tube positioned therein and the surface of the surrounding bore. The bore has a gradually tapered region between the relatively wide region adjacent the front face of the tubesheet (i.e., the fly distance region) and the relatively narrow region adjacent the rear face of the tubesheet (i.e., the clearance fit region).

The fly distance between the tube and the bore adjacent the front face of the tubesheet enables a metallurgical bond to be formed kinetically between an exterior surface portion of the tube and a surface portion of the surrounding bore following detonation of a bonding charge in the tube. A portion of the tube adjacent the front face of the tubesheet expands upon detonation of the bonding charge, and "flies" into the surface of the surrounding bore with sufficient kinetic energy to produce the metallurgical bond.

The clearance fit between the tube an the bore adjacent the rear face of the tubesheet provides lateral and concentric alignment of the tube within the bore, which facilitates parallel alignment of the tube with other tubes positioned in other bores in the tubesheet. The clearance fit also provides a bearing area between the tube and the bore, which protects the bond between the tube and the bore from bending stresses that are apt to develop during operation of the heat exchanger. The bearing area serves to minimize the effect that tube vibrations occurring during heat exchanger operations might have on the bond. Also, the bearing area provides a "go/no go" quality control on tube ovality when the tube is being positioned in the bore.

For the usual heat exchanger tubesheet, circularly cylindrical tubes are positioned in circularly cylindrical bores so that each tube terminates adjacent the front face of the tubesheet. The tubes are ordinarily positioned so that an end of each tube is slightly under-flush with respect to the front face of the tubesheet. This under-flush positioning of the tubes provides a slightly bell-shaped opening for each of the tubes when bonded at the front face of the tubesheet, thereby optimizing hydrodynamic flow characteristics of cooling water entering the tubes. The present invention, however, is not dependent upon the particular cross-sectional configuration of the tubes and bores, or upon whether the tubes terminate adjacent the front face of the tubesheet. Where required by a particular application, the present invention could be practiced using bonding charges designed to accommodate, e.g., cylindrical tubes having non-circular cross-sectional configurations.

The explosive package of the present invention comprises the bonding charge and a disposable container, which houses the bonding charge. The container is fabricated from a chemically stable moldable plastic material, preferably polypropylene, which produces non-toxic vapors upon being vaporized by detonation of the bonding charge. The container shapes the bonding charge, and positions the bonding charge within the tube, so that forces resulting from detonation of the bonding charge drive a portion of the tube laterally outward through an intervening fly distance into the surface of the surrounding bore. The bonding charge is shaped and positioned by the container so that the resulting metallurgical bond formed between the tube and the bore is strongest adjacent the front face of the tubesheet. In structural detail, the container comprises a cup structure forming a receptacle for the bonding charge, and a header structure containing explosive means for initiating detonation of the bonding charge. In the preferred embodiment, the header structure contains a transfer charge and a firing charge pellet to facilitate detonation of the transfer charge.

The cup structure has a hollow circularly cylindrical portion of appropriate diameter and length, depending upon the particular application, for insertion into the tube positioned in the tubesheet bore. A closure portion of the cup structure extends across the cylindrical portion to form the receptacle region in which the bonding charge is received. A flange portion of the cup structure extends outwardly from the cylindrical portion, and is attached to an elongate spacer portion that extends coaxially with and generally parallel to the cylindrical portion. One end of the spacer portion abuts against the front face of the tubesheet when the cylindrical portion is inserted into the tube. The spacer portion of the cup structure limits the depth to which the explosive package can extend into the tube, thereby positioning the bonding charge at the desired depth within the tube.

The header structure has an outer circularly cylindrical wall portion, which is appropriately dimensioned for insertion with a clearance fit into the cylindrical portion of the cup structure. The header structure also has an inner cylindrical portion, which defines an elongate region in which the transfer charge is contained. The elongate region of the inner cylindrical portion of the header structure is in communication with the receptacle region of the cup structure so that the transfer charge makes contact with the bonding charge. Preferably, the transfer charge protrudes from the elongate region of the header structure into the receptacle region of the cup structure so as to maximize the area of interfacing contact between the transfer charge and the bonding charge.

A bottom portion of the header structure extends as an inverted truncated cone from the inner cylindrical portion of the header structure to the outer cylindrical wall portion of the header structure. The bottom portion of the header structure overlies the bonding charge in the receptacle region of the cup structure, and shapes the bonding charge so as to achieve the desired bonding effect when the bonding charge is detonated. The bottom portion of the header structure is configured to provide an axially symmetric distribution of the bonding charge inside the tube, and shapes the bonding charge so that forces occurring when the bonding charge is detonated cause the resulting bond between the tube and the surface of the surrounding bore to be strongest adjacent the front face of the tubesheet.

An explosive package in accordance with this invention is inserted into each tube of the array of tubes positioned in the corrresponding bores of the tubesheet. The spacer portions of the cup structures of the individual explosive packages are of hexagonally cylindrical configuration, which enables the spacer portions of the various cup structures to nest with respect to each other on the front face of the tubesheet so that the entire front face of the tubesheet in the vicinity of the bores is covered by the spacer portions when the explosive packages are inserted into the tubes. In this way, the front face of the tubesheet is protected from scratching or pitting that might otherwise be caused by explosives used in the firing assembly for initiating bonding charge detonations in the individual explosive packages.

The bores in the tubesheet, and hence the explosive packages inserted into the tubes positioned in the bores, are arranged in a plurality of linear arrays on the tubesheet. Each explosive package has a pair of arms extending upward from the bottom portion of the header structure generally parallel to the inner cylindrical portion of the header structure. Distal ends of each pair of arms are configured to grasp a firing rail member of the firing assembly. In this way, a firing rail can be secured to all the explosive packages in a particular linear array of tubes positioned in a corresponding linear array of bores on the tubesheet. A plurality of firing rails is provided,one firing rail for each linear array of tubes. The total number of firing rails depends upon the number of linear arrays of tubes to be bonded to the tubesheet.

Detonation of the bonding charge in a given explosive package is initiated by detonation of the transfer charge in the inner cylindrical portion of the header structure of the explosive package. Detonation of the transfer charge is initiated by detonation of the firing charge pellet, which is received in an interior region of the upper end of the inner cylindrical portion of the header structure. The interior upper end region is in communication with the elongate region, so that the firing charge is in contact with the transfer charge.

A linear charge, which detonates progressively with the passage of time, is secured to each firing rail. The firing rail is secured to each of the explosive packages in the tubes positioned in the corresponding linear array of bores. Detonations of the firing charges in the explosive packages of the linear array are initiated sequentially as detonation of the linear charge on the firing rail progresses with time. An initiation rail is positioned across and secured to the various firing rails, and a linear initiation charge is secured to the initiation rail. The linear charges on the various firing rails are detonated in sequence as detonation of the linear initiation charge on the initiation rail progresses with time.

A detailed specification for the preferred embodiment of the present invention is described hereinafter with reference to the accompanying drawing. The specification and drawing set forth the best mode presently contemplated by the inventors for carrying out the invention, although functionally equivalent modes could be inferred by those skilled in the art upon studying the disclosure herein.

BEST MODE OF CARRYING OUT THE INVENTION

Figure 1:
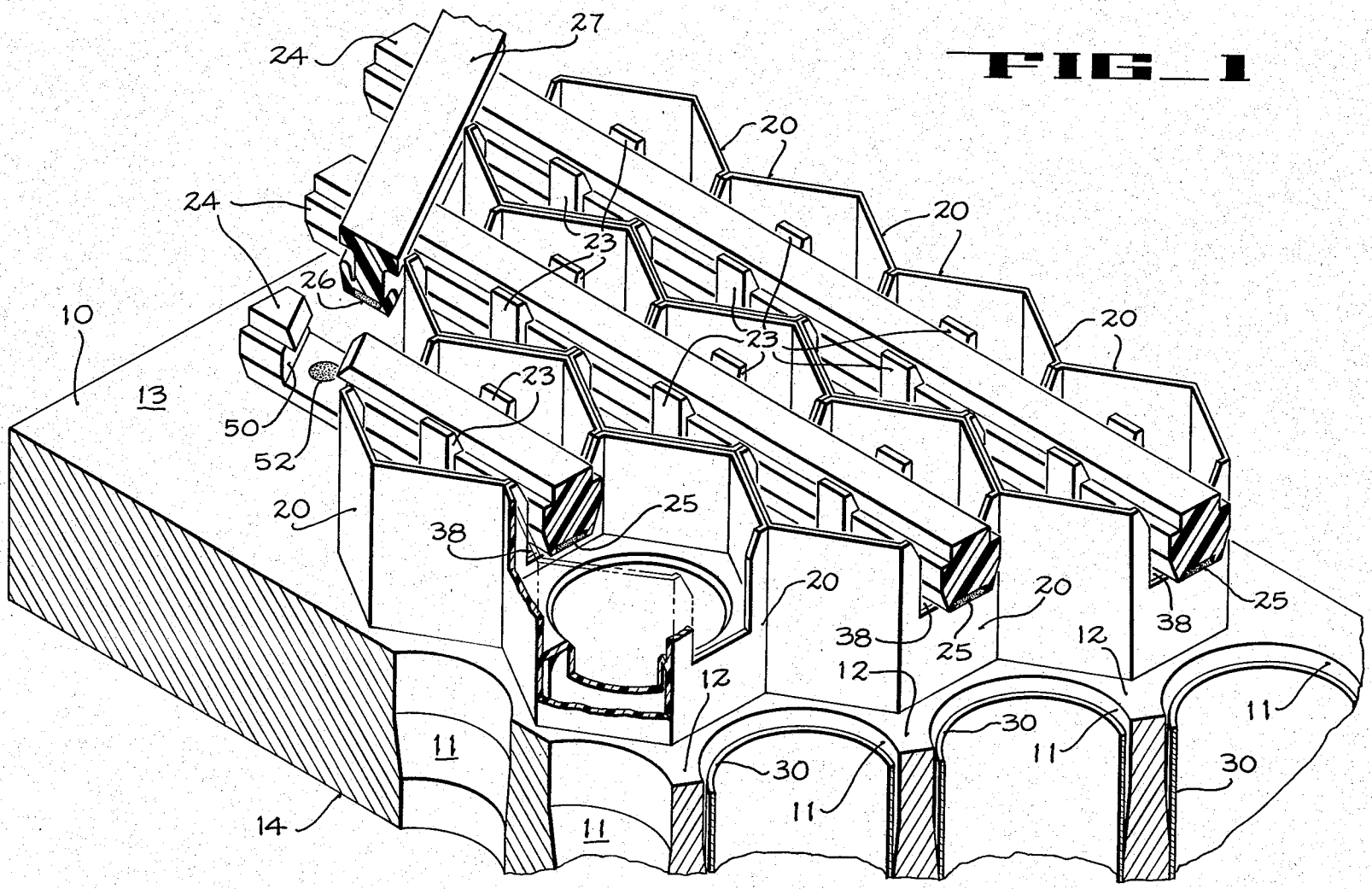
FIG. 1 is a perspective view, partially in cross section, of apparatus according to the present invention for bonding an array of metal tubes to a metal tubesheet.

A tubesheet 10, as illustrated in perspective cross-sectional view in FIG. 1, has a plurality of circularly cylindrical bores 11 arranged in a rectangular distribution of parallel linear arrays. The bores 11 are uniform with respect to each other in internal configuration. Any two adjacent bores 11, whether in the same linear array or in adjacent linear arrays, are separated from each other by a portion of the tubesheet 10 denominated a "ligament" 12.

In accordance with the present invention, metal tubes are positioned in corresponding bores 11 for kinetic bonding to surface portions of the bores 11 by explosive bonding charges. It is a feature of the present invention that the ligament 12 between any two adjacent bores 11 may be much smaller than the diameter of the bores 11, so that a relatively dense assemblage of tubes can be bonded to the tubesheet 10. While the invention does not depend upon the types of metal from which the tubesheet 10 and the tubes are fabricated, it is noteworthy that the kinetic bonding technique of the present invention can be used where the tubesheet 10 and the tubes are made of dissimilar metals. Conventional welding techniques on the other hand are generally not suited for bonding dissimilar metals of the kinds typically used e.g., in steam condensers. In tests of the invention, tubes have been routinely bonded to tubesheets where the minimum ligament width between adjacent bores was as narrowas standard steam condenser design practice presently allows, i.e., where the minimum spacing between adjacent bore centers was 1.2 times the outside diameter of the tubes positioned in the adjacent bores.

Each bore 11 is dimensioned to provide an annular gap, denominated a "fly distance", adjacent a front face 13 of the tubesheet 10 between an exterior surface portion of the tube positioned therein and the surface of the surrounding bore 11. Adjacent a rear face 14 of the tubesheet 10, each bore 11 is reduced in diameter to provide a clearance fit between the exterior surface of the tube and the surface of the surrounding bore 11. The bore 11 has a gradually tapered region between the relatively wide region adjacent the front face 13 (i.e., the fly distance region) and the relatively narrow region adjacent the rear face 14 (i.e., the clearance fit region) of the tubesheet 10.

Figure 2:
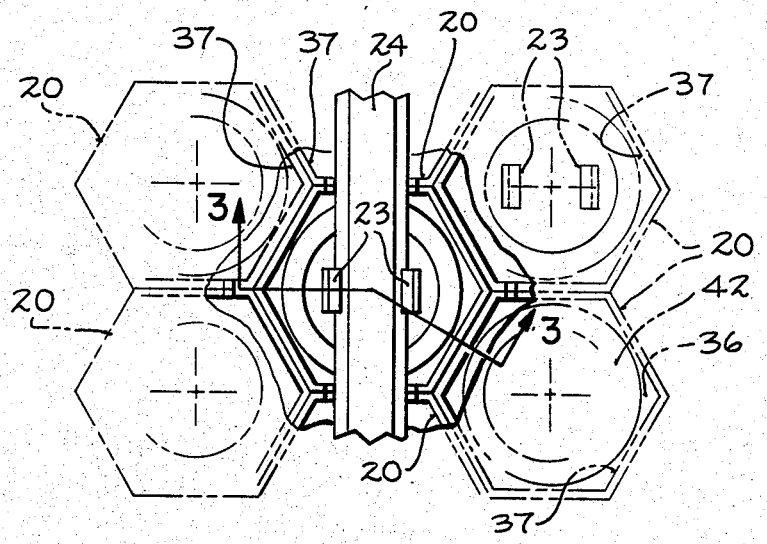
FIG. 2 is a plan view of an explosive package and firing rail of the apparatus shown in FIG. 1.

A plurality of explosive packages 20 is provided for insertion into corresponding tubes positioned in corresponding bores 11, as shown in plan view in FIG. 2. The individual explosive packages 20 for a particular application are usually fungible with respect to each other, and could be manufactured in standardized sizes for standardized applications. Each explosive package 20 comprises a bonding charge contained in a disposable plastic container, which is configured to position the bonding charge within the tube adjacent the front face 13 of the tubesheet 10.

Figure 3:
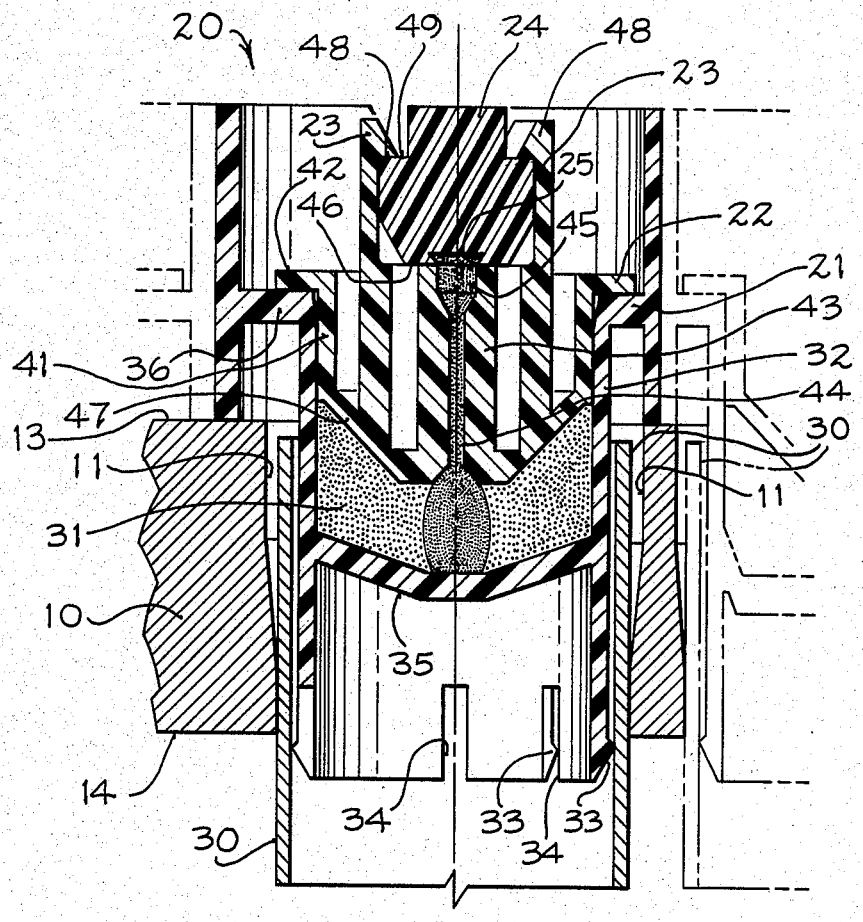
FIG. 3 is an angled sectional view of the explosive package of the present invention taken along line 3—3 of FIG. 2.

As shown in angled sectional view in FIG. 3, the plastic container of the explosive package 20 comprises a cup structure 21 configured to form a receptacle for the bonding charge and a header structure 22 configured to shape the bonding charge. It is a feature of the present invention that the bonding charge comprises substantially pure explosive material, and does not need any non-explosive bonding agent to maintain the explosive material in proper shape for achieving the desired bonding effect when the bonding charge is detonated.

The header structure 22 of each explosive package 20 has a pair of arms 23 extending upward to grasp a firing rail 24, which supports a linear charge 25 that detonates along its length progressively with time. The linear charge 25 of each firing rail 24 is used to initiate detonations of the bonding charges in the various explosive packages 20 in the corresponding tubes positioned in a particular linear array of bores 11. There is one firing rail 24 for the explosive packages 20 in each linear array of tubes and each firing rail 24 is secured by the pairs of arms 23 to all of the explosive packages 20 in that particular linear array. There is a plurality of firing rails 24 depending upon the number of linear arrays of bores 11, and detonations of the linear charges 25 of the various firing rails 24 are initiated in sequence by detonation of a linear initiation charge 26 supported by an initiation rail 27. As shown in FIG. 1, the initiation rail 27 crosses and is secured to each of the firing rails 24. Detonation of the linear initiation charge 26 can be effected by conventional means, such as a blasting cap, when the kinetic bonding process is to commence.

In FIG. 3, a metal tube 30 is shown positioned within the bore 11 so that an upper end of the tube 30 is slightly under-flush with respect to the front face 13 of the tubesheet 10. Adjacent the front face 13 of the tubesheet 10, the bore 11 is relatively wide in diameter to provide a fly distance between the exterior surface of the tube 30 and the surrounding surface of the bore 11. Adjacent the rear face 14 (also known as the "steamside" face) of the tubesheet 10, the bore 11 is reduced in diameter to provide a clearance fit between the exterior surface of the tube 30 and the surrounding surface of the bore 11. There is a gradually tapered intermediate region of the bore 11 between the relatively wide fly distance region adjacent the front face 13 and the relatively narrow clearance fit region adjacent the rear face 14 of the tubesheet 10. The clearance fit between the tube 30 and the bore 11 adjacent the rear face 14 of the tubesheet 10 facilitates lateral and concentric alignment of the tube 30 within the bore 11.

The plastic container of the explosive package 20 is seen in FIG. 3 to house a bonding charge 31, which is positioned within the tube 30 adjacent the front face 13 of the tubesheet 10. The bonding charge 31, upon detonation, causes a portion of the tube 30 adjacent the front face 13 of the tubesheet 10 to expand laterally outward through the annular fly distance and to impact upon the surface of the bore 11 with sufficient kinetic energy to weld the exterior surface of the tube 30 to the surface of the bore 11 adjacent the front face 13. The bonding charge 31 is shaped by the cup structure 21 and the header structure 22 so that forces resulting from the detonation of the bonding charge 31 cause the welded bond between the exterior surface of the tube 30 and the surrounding surface of the bore 11 to be strongest immediately adjacent the front face 13 of the tubesheet 10.

The under-flush positioning of the end of the tube 30 and the tapering of the bore 11 provide a slightly bell-shaped opening for the tube 30 after bonding of the tube 30 to the tubesheet 10 has been achieved. The clearance fit between the tube 30 and the bore 11 adjacent the rear face 14 of the tubesheet 10, provides a bearing surface interface between the tube 30 and the bore 11. This bearing surface protects the bond from bending stresses that are apt to develop when the tubesheet 10, with the tubes 30 bonded thereto, is subsequentlysubjected to the operating environment of, e.g., a steam condenser. The bearing surface adjacent the rear face 14 of the tubesheet 10 also serves to minimize bulging of the tube 30 outside the bore 11 due to detonation of the bonding charge 31.

The plastic container of the explosive package 20 is made of a moldable material that produces non-toxic vapors when the bonding charge 31 is detonated.A particularly well-suited material for the container is polypropylene, which is translucent and enables visual inspection of the bonding charge 31. The bonding charge 31 is a secondary explosive that is stable and relatively safe from accidental detonation. A particularly well-suited material for the bonding charge 31 is nitroguanidine powder. The quantity and density of the nitroguanidine powder used would be selected to suit the dimensions and configurations of the tubesheet 10, the bores 11 and the tubes 30.

The cup structure 21 of the container for the bonding charge 31 has a hollow circularly cylindrical portion 32, which is dimensioned for insertion into the tube 30. A lower end of the hollow cylindrical portion 32 has a rim 33, which extends laterally outward and bears against the interior surface of the tube 30 when the hollow cylindrical portion 32 is inserted into the tube 30. A plurality of longitudinally extending slots 34 (e.g., four symmetrically disposed slots) are provided at the lower end of the hollow cylindrical portion 32 to accommodate flection of the lower end of the hollow cylindrical portion 32 as the explosive package 20 is being inserted into the tube 30. In the angled sectional view of FIG. 3, as indicated by the arrows in FIG. 2, two such slots 34 are shown. Inward flection of the slotted lower end of the hollow cylindrical portion 32 enables the rim 33 to make springing contact with the interior surface of the tube 30, whereby manufacturing tolerances for the tube 30 can be accommodated.

The cup structure 21 also has a closure portion 35 extending transversely across the hollow cylindrical portion 32. The closure portion 35 and the hollow cylindrical portion 32 form a receptacle region in which the bonding charge 31 is received. An upper end of the hollow cylindrical portion 32 has a flange portion 36, which extends laterally outward beyond the diameter of the bore 11 at the front face 13 of the tubesheet 10. Connected to the flange portion 36 is a spacer portion 37, which is hexagonally cylindrical and generally coaxial with respect to the hollow cylindrical portion 32. A lower end of the spacer portion 37 abuts against the front face 13 of the tubesheet 10, thereby limiting the extent to which the explosive package 20 can be inserted into the tube 30.

The spacer portion 37 of the cup structure 21 serves to position the bonding charge 31 within the tube 30 at an appropriate depth for making the bond between the tube 30 and surface of the bore 11 strongest at the front face 13 of the tubesheet 10. As shown in FIG. 3, the bonding charge 31 is positioned by the cup structure 21 of the explosive package 20 so that the mass of the bonding charge 31 within the tube 30 inside the bore 11 is located preponderantly below the front face 13 of the tubesheet 10. The depth to which the bonding charge 31 is inserted into the tube 30 is also a factor in determining the extent of bulging of the tube 30 immediately outside the bore 11 adjacent the rear face 14 of the tubesheet 10 as a result of detonation of the bonding charge 31. A slight rear face bulging serves to swage the tube 30 to the bore 11 at the rear face 14 of the tubesheet 10, and thereby prevents steamside crevicing in a steam condenser.

As can be seen, in FIGS. 1 and 2, the hexagonal configuration of the spacer portions 37 of the various cup structures 21 enables adjacent spacer portions 37 to nest with respect to each other on the front face 13 of the tubesheet 10, thereby collectively forming a protective covering for the entire front face 13 during the explosive bonding process. Slots 38, as seen in FIG. 1, are provided on two opposing walls of each hexagonally configured spacer portion 37. The slots 38 accommodate positioning of the particular firing rail 24 so that the linear charge 25 on the underside of the firing rail 24 can initiate detonations of the bonding charges 31 in the particular linear array of explosive packages 20 secured to the particular firing rail 24.

The header structure 22 of the container for the bonding charge 31 has an outer circularly cylindrical wall portion 41, which is dimensioned for insertion with a clearance fit into the hollow cylindrical portion 32 of the cup structure 21. A flange portion 42 of the header structure 22 extends laterally outward from the outer cylindrical wall portion 41 beyond the diameter of the hollow cylindrical portion 32 of the cup structure 21, and overlies the flange portion 36 of the cup structure 21. The header structure 22 also has an inner hollow circularly cylindrical portion 43, which defines an elongate region in which an explosive transfer charge 44 is contained.

The elongate region of the header structure 22 is in communication with the receptable region of the cup structure 21 so that the transfer charge 44 is in contact with the bonding charge 31. Preferably, the transfer charge 44 extends downward from the elongate region of the header structure 22 through the receptacle region of the cup structure 21 to the closure portion 35 of the cup structure 21. In this way, the area of interfacing contact between the transfer charge 44 and the bonding charge 31 is maximized. The transfer charge 44 is used to initiate detonation of the bonding charge 31, and is preferably a mixture of pentaerythritol tetranitrate (PETN) and an elastomer, e.g., the explosive product sold by E. I. du Pont de Nemours & Company under the trademark Detasheet.

An upper end of the inner hollow cylindrical portion 43 of the header structure 22 is internally configured to define a region in which an explosive firing charge 45 is received. The firing charge region is in communication with the elongate region in which the transfer charge 44 is received so that the firing charge 45 is in contact with the transfer charge 44. The firing charge 45 is used to initiate detonation of the transfer charge 44, and preferably comprises a pellet of substantially pure pentaerythritol tetranitrate (PETN). The firing charge 45 is more easily detonated than the transfer charge 44, and serves to facilitate a 90-degree change in the direction of propagation of the temporally progressing detonation from the linear charge 25 to the transfer charge 44. A thin covering sheet 46, about 3 mils in thickness, is secured to the upper end of the inner hollow cylindrical portion 43 of the header structure 22 to protect the firing charge 45 from dust and moisture. The covering sheet 46 may be made of paper, or metallic foil, or a clear plastic material.

Polypropylene, which is the preferred material for the cup structure 21 and the header structure 22, is a translucent material through which the bonding charge 31, the transfer charge 44 and the firing charge 45 can be seen. The nitroguanidine used for the bonding charge 31 is ordinarily of a whitish color, and the Detasheet transfer charge 44 is ordinarily of a greenish black color. The firing charge pellet 45 can be given a desired color (e.g., red) to provide visual contrast with the transfer charge 44. The translucent nature of polypropylene provides visual quality control assurance that the explosive charges are properly in place in each explosive package 20.

A bottom portion 47 of the header structure 22 extends from the inner hollow cylindrical portion 43 to the outer hollow cylindrical wall portion 41 of the header structure 22, and overlies the bonding charge 31 received in the receptacle region of the cup structure 21. When the header structure 22 is inserted into the cup structure 21, the bottom portion 41 of the header structure 22 assumes the orientation of an inverted truncated cone. The bottom portion 47 compresses the bonding charge 31 and causes it to assume an axially symmetric distribution within the cap structure 21 in the vicinity of the front face 13 of the tubesheet 10.

The arms 23 that grasp the firing rail 24 extend outward from the bottom portion 47 of the header structure 22 generally parallel to both the inner and outer hollow cylindrical portions 43 and 41, respectively. When the receptacle region of the cup structure 21 has been filled with the proper quantity of bonding charge powder and the header structure 22 has been fitted with the transfer charge 44 and with the firing charge 45, the header structure 22 is joined to the cup structure 21 by heat-sealing the flange portion 42 to the flange portion 36.

Figures 4, 5:
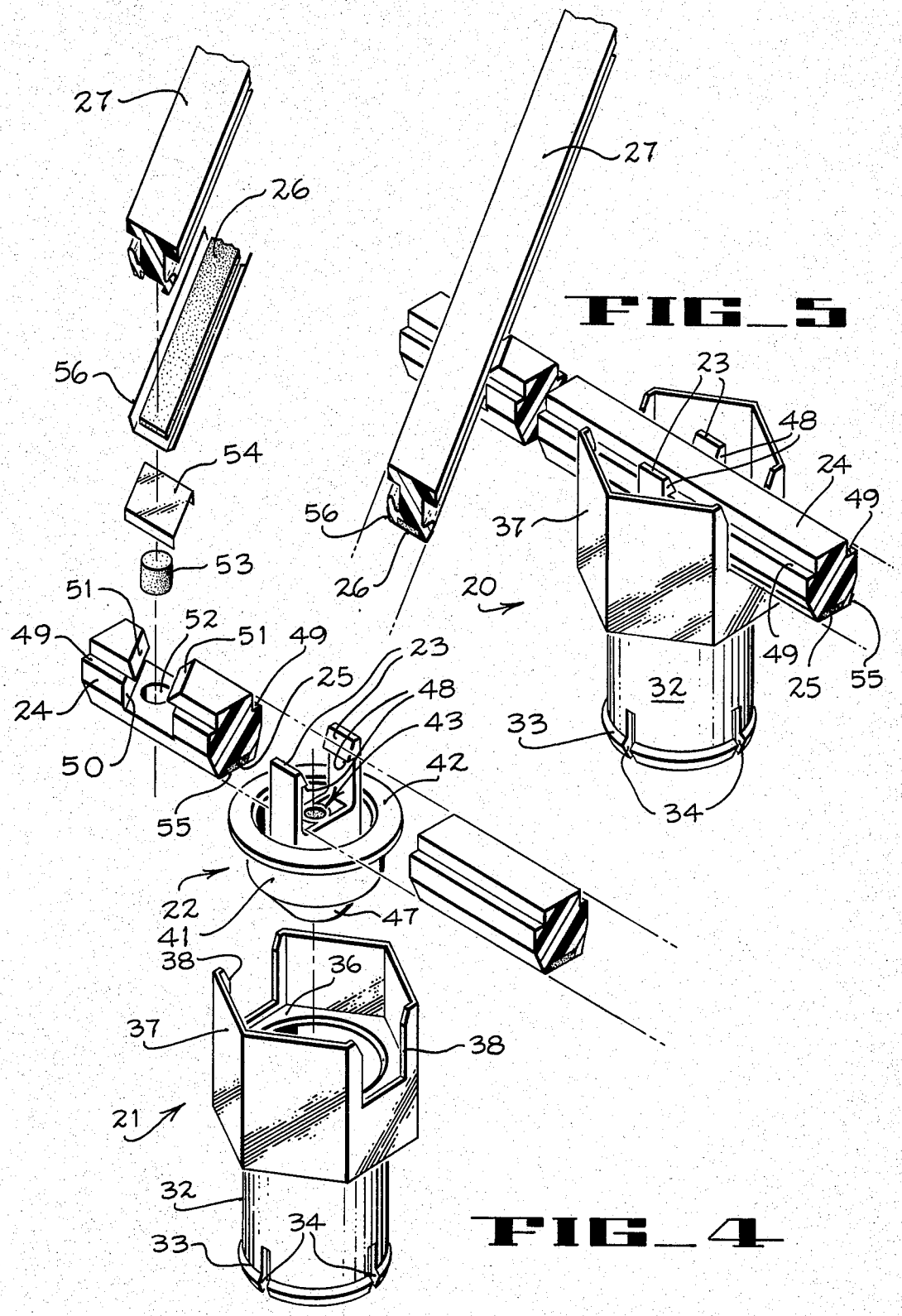
FIG. 4 is an exploded view in perspective of the explosive package and firing rail of the present invention.
FIG. 5 is an assembled view in perspective of the explosive package and firing rail of FIG. 4.

In the exploded view of FIG. 4, detailed features of the cup structure 21 and the header structure 22 are shown in perspective. Attachment of the firing rail 24 to the explosive package 20 is accomplished by inserting the firing rail 24 between the two arms 23 so that detents 48 on the distal ends of the arms 23 snap onto ledge portions 49 on the firing rail 24. When the firing rail 24 is locked in place by the detents 48, the linear charge 25 on the underside of the firing rail 24 is positioned to detonate the firing charge 45 in the upper end of the inner hollow cylindrical portion 43 of the header structure 22.

As detonation of the linear charge 25 on any particular firing rail 24 progresses with time, the individual firing charges 45 in the linear array of explosive packages 20 secured to that particular firing rail 24 are detonated in sequence. When detonation of the linear charge 25 reaches the firing charge 45 of a given explosive package 20, that firing charge 45 is detonated, which initiates detonation of the transfer charge 44, which in turn initiates detonation of the bonding charge 31 of the given explosive package 20. Since the individual firing charges 45 of the various explosive packages 20 in a particular linear array are detonated at different times, simultaneous bonding charge detonations in adjacent tubes 30 of the same linear array are precluded.

As shown in FIG. 4, the linear charge 25 is fitted into a longitudinally extending notch on the underside of the firing rail 24. In order to initiate detonations of a plurality of firing rails 24, a notch 50 is provided on the upper side of each firing rail 24 to receive the initiation rail 27. The upper surface of each firing rail 24 adjacent the notch 50 is configured with detents 51, which enable the initiation rail 27 to be snapped into position on each of the firing rails 24. The bore 52 through each firing rail 24 is provided in the notch 50, and an explosive transfer charge pellet 53 is inserted into the bore 52. The transfer charge pellet 53 is preferably made of substantially pure pentaerythritol tetranitrate (PETN), and serves to facilitate the change in direction of propagation of the temporally progressing detonation from the linear initiation charge 26 to the linear charge 25.

In the preferred embodiment, a thin covering patch 54 (e.g., a patch of paper, metallic foil or clear plastic) is secured to the firing rail 24 over the transfer charge pellet 53 to protect the pellet 53 from dust and/or moisture. Similarly, a thin covering strip 55, e.g., a strip of paper or metallic foil, is secured to the underside of the firing rail 24 over the linear charge 25 in the preferred embodiment to protect the linear charge 25 from dirt and/or moisture. The covering patch 54 and the covering strip 55 on the firing rail 24, as well as the covering sheet 46 over the firing charge 45 in the explosive package 20, are thin enough (e.g., about three mils) to be destroyed when the linear charges 26 and 25 are detonated in their vicinity, and consequently do not interrupt the progress of the linear charge detonations along the rails 27 and 24.

When the initiation rail 27 is locked in place on the various firing rails 24, as shown in FIG. 5, the linear initiation charge 25 supported by the initiation rail 27 is positioned to lie over the covering sheets 54 protecting the transfer charge pellets 53 in the bores 52 of the firing rails 24. Preferably, a thin covering strip 56 (e.g., a strip of paper, metallic foil or clear plastic) is secured to the underside of the initiation rail 27 over the linear initiation charge 26 to protect the linear initiation charge 26 from dirt and/or moisture. The various linear charges 25 and the linear initiation charge 26 consist of a stable secondary explosive such as pentaerythritol tetranitrate (PETN) mixed with an elastomer. The aforementioned Detasheet explosive is suitable for the linear charges 25 and 26.

It is important that detonation of the bonding charge 31 proceed at a rate such that the tube 30 impacts the surface of the tubesheet bore 11 at a subsonic velocity. If detonation of the bonding charge 31 were to proceed so rapidly as to cause a supersonic shock wave, the resulting bond between the tubesheet 10 and the tube 30 would be subject to delamination effects caused by reflected shock waves. It has been found by experimentation that nitroguanidine of a controlled density, when detonated, produces a subsonic pressure wave that forms an optimum bond between the tubesheet 10 and the tube 30. Nitroguanidine powder is especially suitable for the bonding charge 31 because, in addition to its inherent chemical stability, it can be accurately measured and compressed to obtain the desired density for optimum detonation velocity for the particular application.

Figure 6:
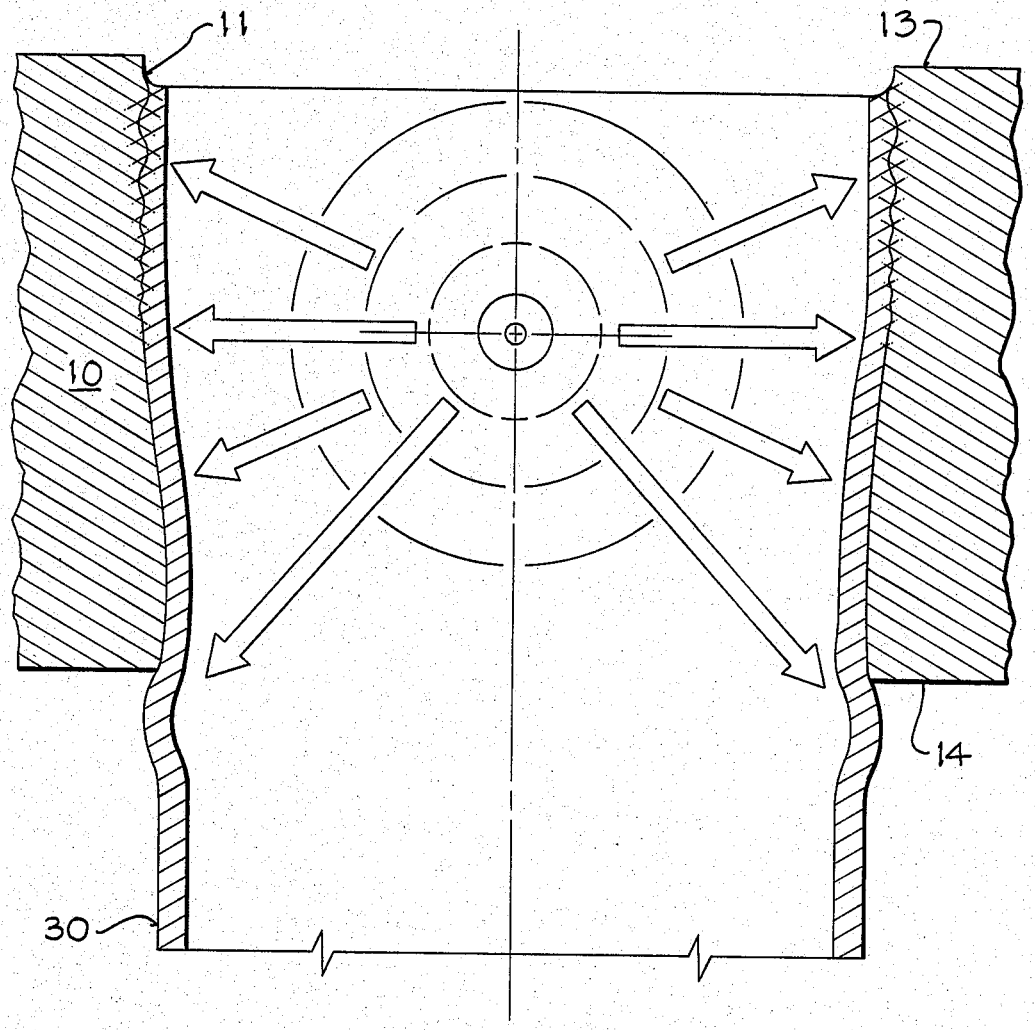
FIG. 6 is a cross-sectional schematic illustration of a tube being bonded to a tubesheet following detonation of a bonding charge in accordance with the present invention.

FIG. 6 is a schematic illustration of the pressure wave resulting from detonation of the bonding charge 31 within the tube 30 adjacent the front face 13 of the tubesheet 10. The pressure wave causes the end portion of the tube 30 to expand laterally outward so as to impact upon the surface of the bore 11 with sufficient kinetic energy to become bonded to the surface of the bore 11. At the interface between the exterior surface of the tube 30 and the surface of the bore 11, a metallurgical alloying occurs. Immediately beneath the rear face 14 of the tubesheet 10, a slight bulging of the tube 30 occurs. The extent of tube bulging is minimized by the relatively large bearing area between the tube 30 and the bore 11 adjacent the rear face of the tubesheet 10 prior to detonation of the bonding charge 31. The slight bulging of the tube 30 that does occur is desirable for producing swaged contact between the tube 30 and the tubesheet 10 adjacent the rear face 14 of the tubesheet 10.

Figure 7:
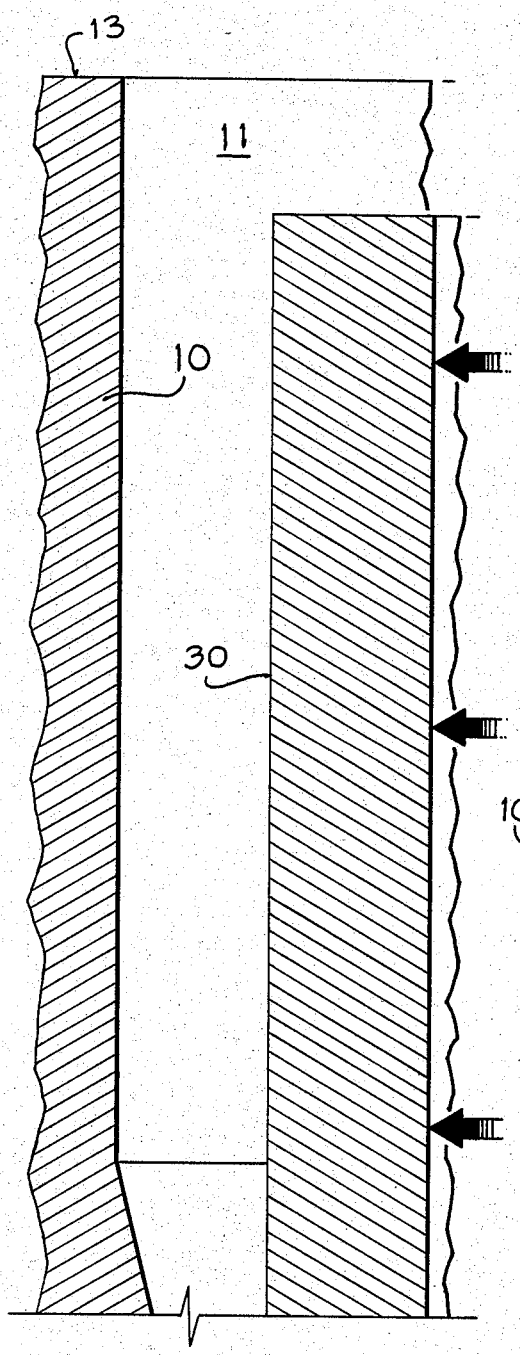
FIG. 7 is an enlarged cross-sectional view of a segment of the tube and tubesheet of FIG. 3 adjacent the front face of the tubesheet prior to detonationof the bonding charge.
Figure 8:
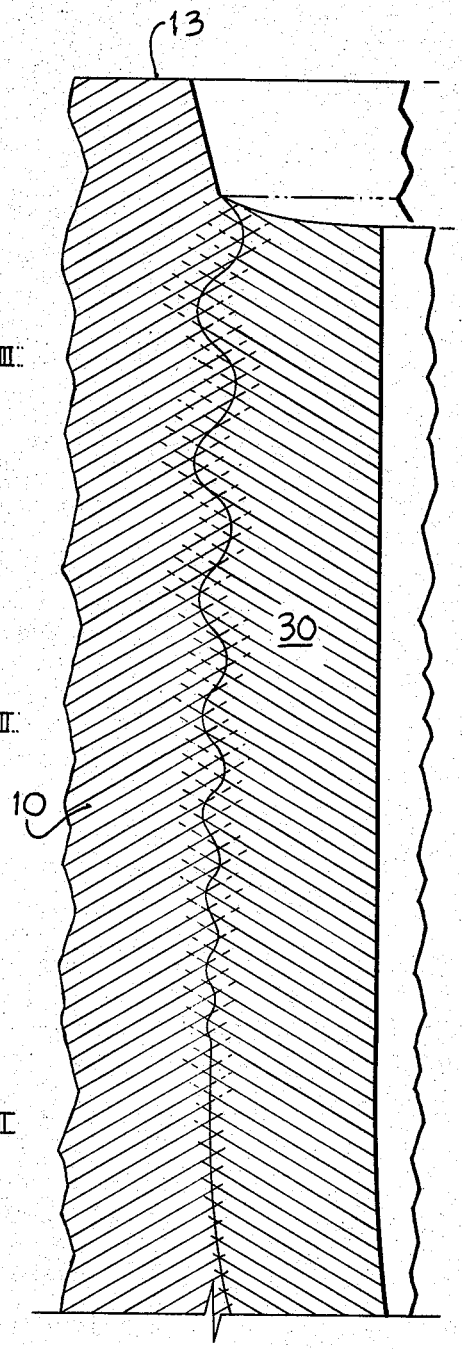
FIG. 8 is an enlarged cross-sectional view of a segment of the tube and tubesheet of FIG. 3 adjacent the front face of the tubesheet after detonation of the bonding charge.

Enlarged segmental views of the tube 30 and the bore 11 in the tubesheet 10 before and after detonation of the bonding charge 31 are shown in FIGS. 7 and 8, respectively. As seen schematically in FIG. 7, the pressure wave resulting from detonation of the bonding charge 31 drives the end of the tube 30 laterally outward toward the surface of the bore 11. As seen in FIG. 8, the alloying effect produced upon impact between the exterior surface of the tube 30 and the surface of the bore 11 results from crystallographic interpenetration of material from the tube 30 into the material of the tubesheet 10, and from a similar crystallographic interpenetration of material from the tubesheet 10 into the material of the tube 30. The alloying effect is indicated in the drawing by interpenetration of the cross-sectional hatching lines for the tube 30 and the tubesheet 10.

Interpenetration of tubesheet material and tube material occurs in a generally sinusoidal pattern, with the amplitude of the sine wave being a correlative indication of the strength of the bond between the tube 30 and the tubesheet 10. In accordance with the present invention, the sine wave amplitude, and hence the strength of the bond between the tube 30 and the tubesheet 10, is greatest adjacent the front face 13 of the tubesheet 10 as shown schematically in FIG. 8. Verification of the fact that the bond is strongest adjacent the front face 13 of the tubesheet 10 can be provided by electron-microscopic analysis of a cross section through the bond.

The strength of the bond produced between the tube 30 and the tubesheet 10 is dependent upon, inter alia, the width of the fly distance between the outer surface of the tube 30 and the surrounding surface of the bore 11. Where the ligament 12 between adjacent bores 11 is relatively thin, detonation of the bonding charge 31 in a given bore 11 tends to produce outward expansion of the bore 11 with consequent movement of the surrounding ligaments 12. Ligament movement between adjacent bores 11 due to non-simultaneity of bonding charge detonations in adjacent bores 11 has a significant effect on bond strength, because ligament movement results in a lessening of the fly distance in adjacent bores 11.

Figure 9:
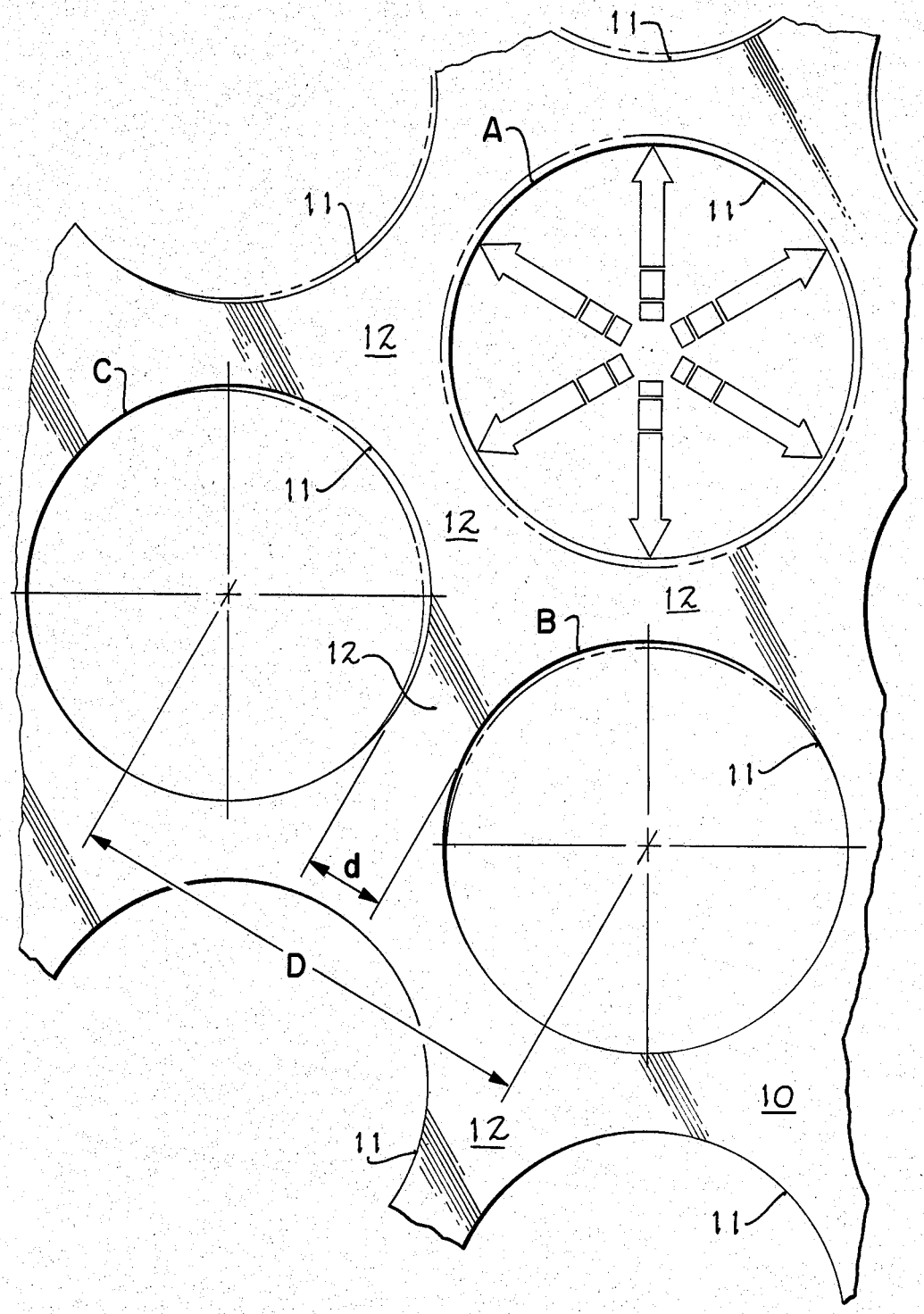
FIG. 9 is a plan view of bores in the tubesheet of FIG. 1 schematically indicating bore movement in reaction to bonding charge detonation.

A segment of a thin-ligament tubesheet 10 is shown in plan view in FIG. 9, where the width d of each ligament 12 is only a fraction of the distance D between the centers of adjacent bores 11. The particular bores 11 indicated by the reference letters A and B in FIG. 9 represent bores in which bonding charges are detonated by the same firing rail, while the bore 11 indicated by the reference letter C represents adjacent bores in which bonding charges are detonated by another firing rail extending parallel to the firing rail associated with bores A and B. Precisely simultaneous bonding charge detonations do not occur in bores A and B, because a time interval is inherently required for the temporally progressing detonation of the linear charge on their common firing rail to proceed from bore A to bore B. Simultaneous bonding charge detonations in bores A and C, or in bores B and C, might occur, but are to be avoided because of the undesirable ligament spalling effects. However, if the time interval between bonding charge detonations in adjacent bores A and B, or bores A and C, or bores B and C, were too long, the bonding charge detonation in, e.g., bore A would move the ligament 12 so as to encroach upon the fly distance of the adjacent bores B and C.

It has been found experimentally that for the minimum ligament thickness currently allowed by standard steam condenser design criteria, i.e., for a minimum ligament thickness of 1.2 times the outside diameter of the tube 30, a time interval of between 5 and 10 microseconds exists between generation of the pressure wave due to detonation of the bonding charge 31 and commencement of movement of the adjacent ligaments 12. It has also been found that ligament spalling can be avoided, if a time lapse of greater than 2.5 microseconds occurs between bonding charge detonations in adjacent tubes 30. Thus, with reference to FIG. 9, if initiation of the bonding charge detonation in bore B can be timed to occur within a "time window" from about 2.5 to 5 microseconds after initiation of the bonding charge detonation in bore A, the adverse effects of ligament spalling and fly distance encroachment can be prevented for bonding charges detonated by the same linear charge. For the same reasons, if initiation of the bonding charge detonation in bore C can be timed to occur within a "time window" from about 2.5 to 5 microseconds after initiation of the bonding charge detonation in bore A and within a "time window" of the same duration before initiation of the bonding charge detonation in bore B, the adverse effects of ligament spalling and fly distance encroachment can be prevented for bonding charges detonated by different linear charges on adjacent firing rails.

The timing to within microsecond tolerances of bonding charge detonations in adjacent tubes 30 is greatly dependent upon the control of physical and chemical parameters involved in manufacturing the various hardware items and explosive materials required for the bonding process. Within the limits of such manufacturing tolerances, however, a temporal firing pattern can be devised to initiate bonding charge detonations in the tubes 30 positioned in the various bores 11 of a thin-ligament tubesheet 10 so as to minimize the adverse effects of ligament spalling and fly distance encroachment. The preferred bonding charge firing pattern may be achieved by means of a firing assembly disposition as shown in FIG. 10, where the initiation rail 27 is seen in plan view to cross each of the different firing rails 24 (designated hereinafter as the first, second, third, etc. firing rails) at an angle of approximately 60 degrees.

Figure 10:
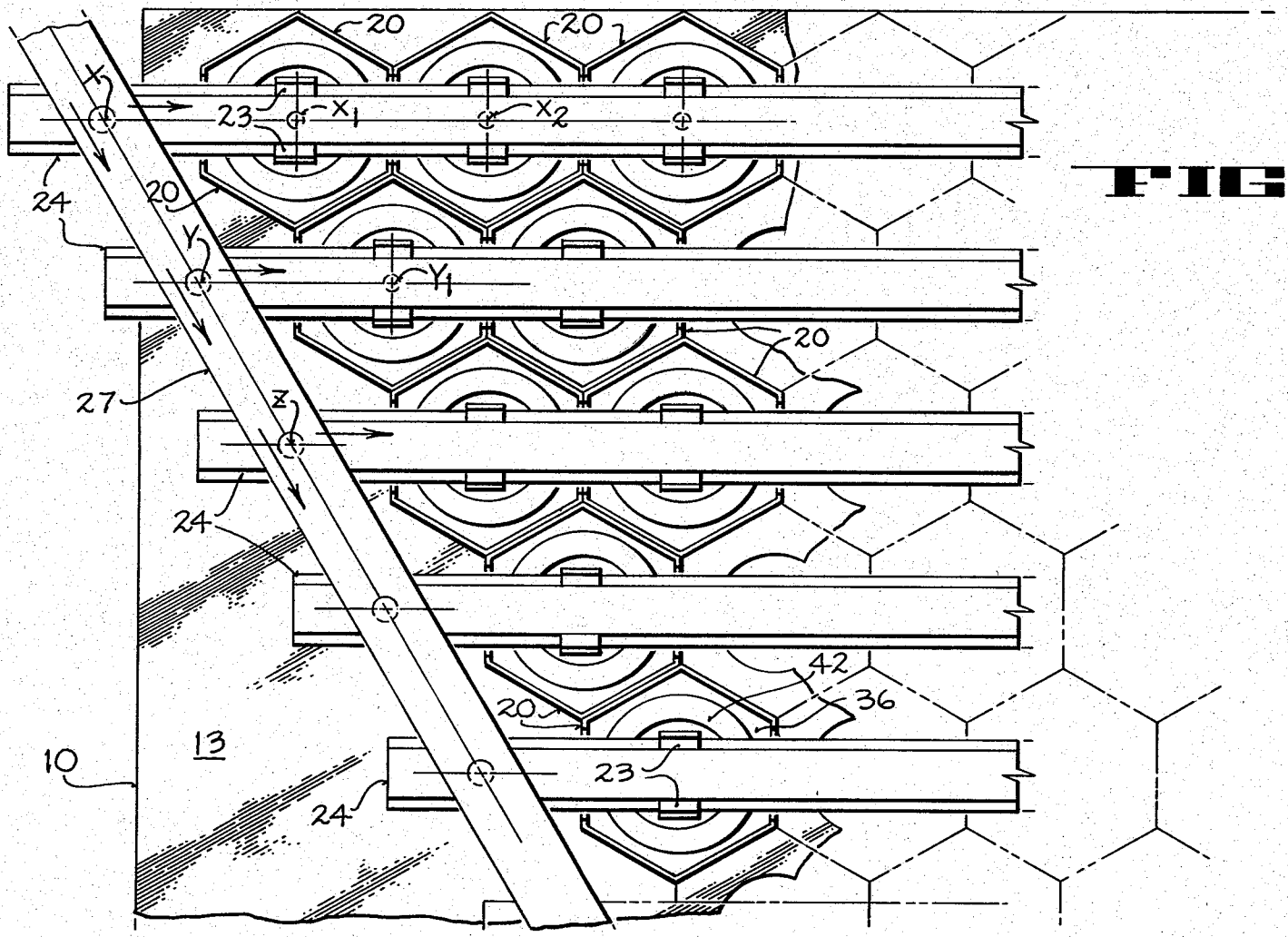
FIG. 10 is a plan view of the apparatus illustrated in FIG. 1 showing a firing rail system initiating bonding charge detonations in every row of tubes of the array.

The linear initiation charge 26 on the initiation rail 27, as seen in FIG. 1 and in the exploded view of FIG. 4, is detonated by conventional means, and the detonation proceeds along the initiation rail 27 in the direction indicated by the arrows in FIG. 10. At a point represented by the letter X on the initiation rail 27, the linear initiation charge detonation travelling along the initiation rail 27 reaches the first firing rail and initiates detonation of the linear charge 25 on the first firing rail. The detonation travelling along the initiation rail 27 continues on the initiation rail 27 to the point Y, where detonation of the linear charge 25 on the second firing rail is then initiated. Meanwhile, the detonation that was initiated on the first firing rail proceeds to the point $X_1$, whereupon detonation of the bonding charge 31 in a first bore of the linear array of bores associated with the first firing rail is initiated.

The detonation trailing along the initiation rail 27 continues on the initiation rail 27 toward the point Z, while the detonation travelling along the first firing rail proceeds toward the point $X_2$ and the detonation that was initiated on the second firing rail proceeds toward the point $Y_1$. The linear spacing between points X and Y, points Y and Z, points X and $X_1$, points $X_1$ and $X_2$, points Y and $Y_1$, etc., is substantially uniform so that the detonations proceeding along the various firing rails 24 initiate bonding charge detonations in adjacent bores 11 within about five microseconds of each other.

Referring to FIG. 10, the time interval for the detonation that proceeds along the first firing rail from point X to point $X_1$ is approximately the same as the time interval for the detonation that proceeds along the initiation rail 27 from point X to point Y. However, detonation of the bonding charge 31 in the bore 11 at point $X_1$ on the first firing rail does not usually occur at precisely the same time as initiation of the linear charge detonation on the second firing rail, because a finite time interval is required for the temporally progressing linear charge detonation at point $X_1$ on the first firing rail to change orientation by 90 degrees in order to initiate detonation of the firing charge 45 in the explosive package 20 in the tube 30 positioned in the first bore at point $X_1$. A further finite time interval is required for the firing charge 45 to initiate detonation of the transfer charge 44, and a further finite time interval is required for the transfer charge 44 to initiate detonation of the bonding charge 31.

Referring again to FIG. 10, the detonation travelling along the first firing rail from point $X_1$ to point $X_2$ proceeds at such a rate as to initiate detonation of the bonding charge 31 in a second bore at point $X_2$ on the first firing rail at nearly (but not precisely) the same time as the detonation traveling along the second firing rail from point Y to point $Y_1$ initiates detonation of the bonding charge 31 in an adjacent first bore at point $Y_1$ on the second firing rail. In this way, encroachment on the fly distance in either one of two adjacent bores 11 by the ligament 12 between the two adjacent bores 11 is prevented. Firing charge detonations in adjacent bores 11 are thereby spaced to occur within a "time window" that is narrow enough to prevent ligament spalling but wide enough to prevent fly distance encroachment. The preferred "time window" for bonding charge detonations in adjacent bores 11 is from 2.5 to 5 microseconds.

Simultaneous bonding charge detonations in adjacent bores 11 associated with different firing rails 24, e.g., in the bores at points $X_1$ and $Y_1$, or at points $X_2$ and $Y_1$, do not ordinarily occur. There is a time lag inherent in the change of orientation of the temporally progressing detonation of the linear initiation charge from the initiation rail 27 to each of the firing rails 24. This inherent time lag due to change in orientation of the linear charge detonation, as well as the accumulation of manufacturing tolerances and explosive material inhomogeneities, tend to prevent simultaneous bonding charge detonations in adjacent bores. Any simultaneous bonding charge detonations that might occur in adjacent bores 11 would occur only randomly, and their occurrence could be minimized as far as practicable by increasing quality control standards in regard to equipment tolerances and chemical purity of the explosive materials.

Figure 11:
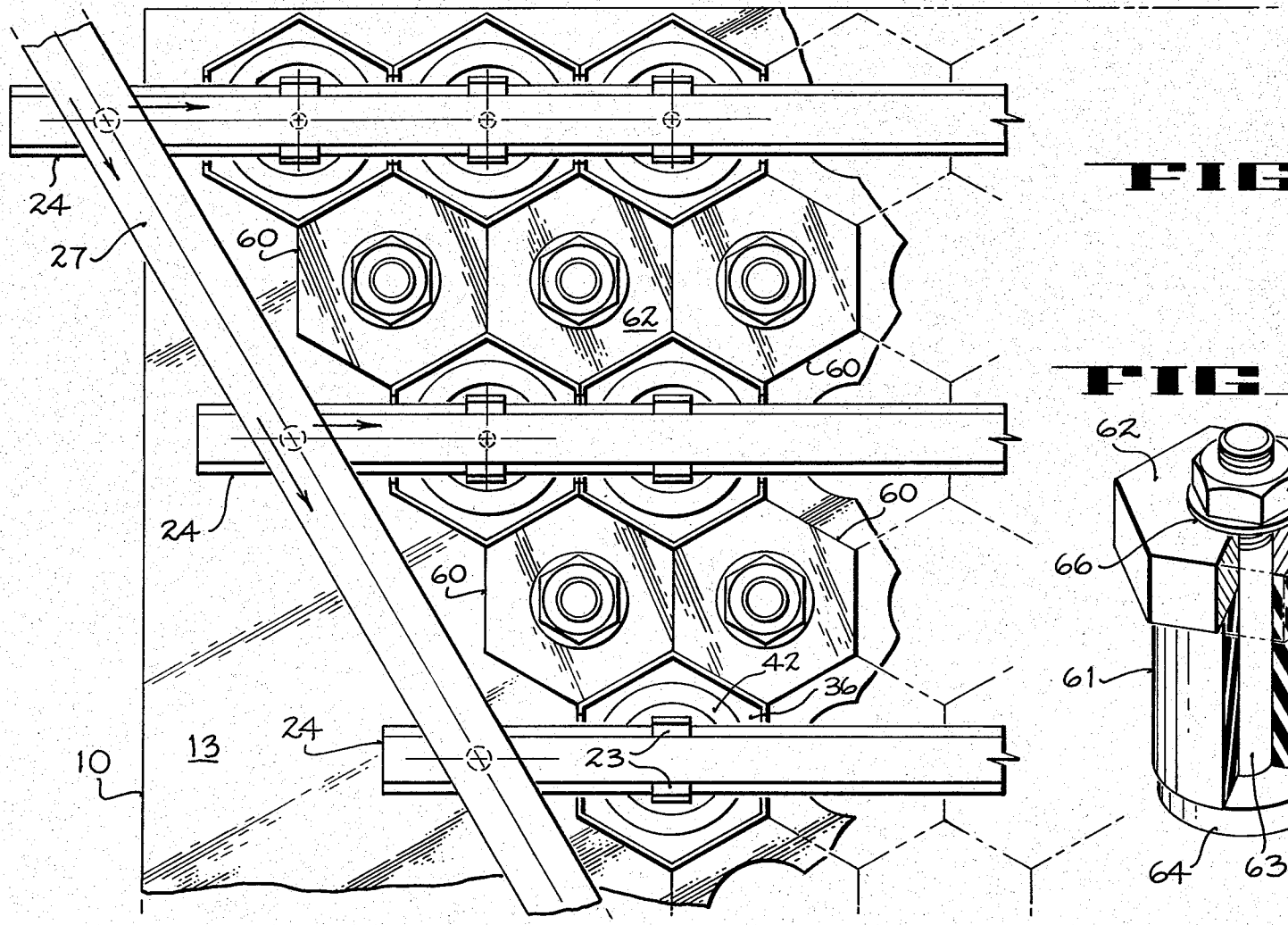
FIG. 11 is a plan view of the kind of apparatus illustrated in FIG. 1 showing a firing rail system for initiating bonding charge detonations in alternate rows of tubes of the array.

In critical bonding applications where the possible occurrence of ligament spalling and/or fly distance encroachment cannot be accepted, the present invention can nevertheless be expediently used to initiate bonding charge detonations only in alternate linear arrays of bores. As shown in FIG. 11, plugs 60 can be inserted instead of explosive packages 20 into the bores 11 of every intervening linear array. The plugs 60 in the intervening arrays prevent bonding charge detonations in the adjacent alternate arrays of bores from causing movement of the ligaments 12 between the intervening arrays and alternate arrays to any significant extent.

Figure 12:
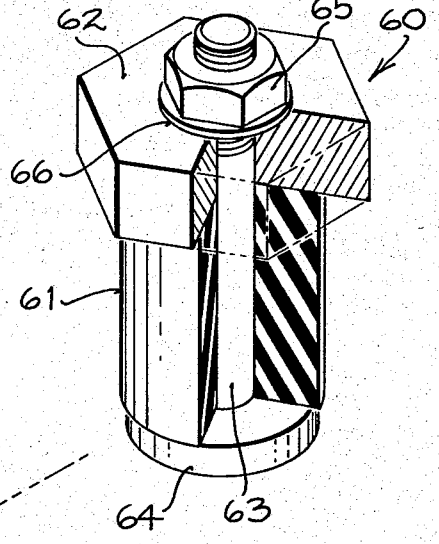
FIG. 12 is a perspective view, partially in cross section, of a plug for insertion into alternate rows of bores when using the firing rail system of FIG. 11.

As shown in FIG. 12, each plug 60 has a generally cylindrical configuration, and is dimensioned for insertion into a bore 11 so as to brace the surface of the bore 11 against a tendency to move in reaction to detonation of a bonding charge 31 in an adjacent bore. The plug 60 preferably has a circularly cylindrical portion 61 made of hard resilient rubber, and a hexagonally cylindrical top portion 62 preferably made of metal. The top portion 62 has lateral dimensions matching those of the spacer portion 37 of the explosive package 20.

The top portions 62 of the various plugs 60 collectively function in the same manner as the spacer portions 37 of the explosive packages 20 in providing a protective covering for the front face 13 of the tubesheet 10 during the explosive bonding process. The rubber cylindrical portion 61 of each plug 60 has an axial bore through which is received a bolt 63 that extends vertically upward from a base plate 64 of circularly cylindrical configuration. The hexagonal top portion 62 of each plug 60 likewise has an axial bore through which the bolt 63 is received so as to sandwich the rubber cylindrical portion 61 between the top portion 62 and the base plate 64. A nut 65 is fitted on the bolt 63 over the top portion 62 to secure the top portion 62 and the rubber cylindrical portion 61 to the base plate 64. Preferably, a metal washer 66 is interposed between the nut 65 and the top portion 62. After the plug 60 is inserted into the bore 11, the nut 65 is torqued so as to compress the rubber cylindrical portion 61 against the surface of the bore 11. The compressed cylindrical portion 61 thereupon conforms to the internal configuration of the bore 11, and thereby resists any encroachment by the ligament 12 into the bore 11 due to a bonding charge detonation in an adjacent bore.

After bonding of the tubes 30 to the tubesheet 10 has occurred in the alternate arrays of bores 11, the plugs 60 in the intervening arrays of bores 11 are removed, and are replaced by explosive packages 20. Similar plugs, whose rubber cylindrical portions have a slightly smaller diameter to accommodate the wall thickness of the tubes 30, can then be inserted into the alternate arrays of bores 11 to which tubes 30 have been bonded. In this way, when the explosive packages 20 in the intervening arrays of bores 11 are subsequently detonated, ligament movement can be prevented and stresses on the bonds previously formed between the tubes 30 and the tubesheet 10 in the alternate arrays of bores 11 can be avoided.

This invention has been described above in terms of a particular embodiment. However, other functionally equivalent embodiments would be apparent to workers skilled in the art upon perusal of the above description and the accompanying drawing, and yet would be within the scope of the invention. Therefore, the above description is to be considered as illustrative of the invention, while the legal definition of the invention is provided more generally by the following claims and their equivalents.

We claim:

1. An apparatus for bonding an exterior surface portion of a metal tube to a surrounding surface portion of a bore in a metal tubesheet, said bore being separated from an adjacent bore in said tubesheet by a ligament portion of said tubesheet, said ligament portion having a transverse dimension less than a transverse dimension of either bore, said apparatus comprising:

(a) an explosive bonding charge; and (b) container means housing said bonding charge, said container means functioning to position said bonding charge within said tube inside said bore preponderantly below a front face of said tubesheet, said container means shaping said bonding charge so that an outwardly facing surface of said bonding charge is generally concave, forces resulting from detonation of said bonding charge as shaped and positioned by said container means thereby causing a metallurgical bond to be formed between said exterior surface portion of said tube and said surrounding surface portion of said bore, said bond being strongest adjacent said front face of said tubesheet.

2. The apparatus of claim 1 wherein said container means comprises a plastic container, said container including a cup structure having:

(a) a hollow cylindrical portion dimensioned for insertion into said tube;

(b) a closure portion extending across said cylindrical portion to form a receptacle region within said cylindrical portion, said bonding charge being received in said receptacle region;

(c) a flange portion extending outwardly from said cylindrical portion; and (d) a spacer portion connected to said flange portion, said spacer portion abutting against said front face of said tubesheet when said cylindrical portion is inserted into said tube, said spacer portion thereby locating said closure portion relative to said front face of said tubesheet so that said bonding charge is positioned for making said bond strongest adjacent said front face of said tubesheet.

3. The apparatus of claim 2 wherein said flange portion of said cup structure is connected to said cylindrical portion of said cup structure at an upper end of said cylindrical portion, said flange portion spanning a gap between said cylindrical portion and said spacer portion of said cup structure.

4. The apparatus of claim 3 wherein said spacer portion of said cup structure is of hollow elongate configuration, said spacer portion being generally coaxial with respect to said cylindrical portion of said cup structure, a lower end of said spacer portion abutting against said front face of said tubesheet when said cylindrical portion is inserted into said tube.

5. The apparatus of claim 4 wherein said flange portion of said cup structure is connected to said spacer portion of said cup structure between an upper end and said lower end of said spacer portion, said flange portion of said cup structure thereby being spaced apart from said front face of said tubesheet when said cylindrical portion of said cup structure is inserted into said tube.

6. The apparatus of claim 5 wherein said container further includes a header structure, said header structure having:

(a) an outer cylindrical wall portion dimensioned for insertion with a clearance fit into said cylindrical portion of said cup structure;

(b) an inner hollow cylindrical portion defining an elongate region in which an explosive transfer charge is contained, said elongate region of said header structure being in communication with said receptacle region of said cup structure so that said transfer charge is in contact with said bonding charge, said transfer charge being used in initiating detonation of said bonding charge;

(c) a bottom portion extending from said inner cylindrical portion of said header structure to said outer cylindrical wall portion of said header structure, said bottom portion of said header structure overlying said bonding charge in said receptacle region of said cup structure, said bottom portion of said header structure being predominantly non-perpendicular to said surface portion of said bore in said tubesheet; and (d) a flange portion extending outwardly from said outer cylindrical wall portion of said header structure, said flange portion of said header structure being dimensioned to overlie said flange portion of said cup structure when said outer cylindrical wall portion of said header structure is inserted into said cylindrical portion of said cup structure.

7. The apparatus of claim 6 wherein said flange portion of said cup structure extends transversely outward from said cylindrical portion of said cup structure and said flange portion of said header structure extends transversely outward from said outer cylindrical wall portion of said header structure, said flange portion of said header structure being sealed to said flange portion of said cup structure.

8. The apparatus of claim 6 wherein said cylindrical portion of said cup structure and said outer cylindrical wall portion of said header structure are circularly cylindrical.

9. The apparatus of claim 8 wherein said inner cylindrical portion of said header structure defining said elongate region is generally coaxial with said outer cylindrical wall portion of said header structure, said bottom portion of said header structure and said closure portion of said cup structure being configured to provide an axially symmetric distribution of said bonding charge in said receptacle region of said cup structure.

10. The apparatus of claim 9 wherein said closure portion of said cup structure extends transversely across said cylindrical portion of said cup structure, and wherein said bottom portion of said header structure extends as an inverted truncated cone from said inner cylindrical portion of said header structure to said outer cylindrical wall portion of said header structure.

11. The apparatus of claim 6 wherein an upper end of said inner cylindrical portion of said header structure provides access to an interior region that is configured to receive an explosive firing charge, said interior upper end region being in communication with said elongate region containing said transfer charge so that said firing charge is in contact with said transfer charge, said firing charge being used in initiating detonation of said transfer charge.

12. The apparatus of claim 6 wherein said header structure has a grasping means whereby a means for initiating detonation of said firing charge can be secured to said container.

13. The apparatus of claim 12 wherein said grasping means comprises a pair of arms extending from said bottom portion of said header structure generally parallel to said inner cylindrical portion of said header structure, distal ends of said arms being configured to grasp said means for initiating detonation of said firing charge.

14. The apparatus of claim 13 wherein said plastic container is made of polypropylene, and wherein said means for positioning said bonding charge within said tube further comprises a covering sheet secured transversely across said upper end of said inner cylindrical portion of said header structure, said covering sheet overlying said firing charge.

15. The apparatus of claim 14 wherein said covering sheet is made of paper.

16. The apparatus of claim 14 wherein said covering sheet is made of a metallic foil.

17. The apparatus of claim 2 wherein a lower end of said cylindrical portion of said cup structure extends below said closure portion of said cup structure, said lower end of said cylindrical portion being configured to make springing contact with an interior surface portion of said tube when said cylindrical portion is inserted into said tube.

18. The apparatus of claim 17 wherein said lower end of said cylindrical portion of said cup structure has a rim extending transversely outward, with longitudinally extending slots being provided in said cylindrical portion at said lower end to accommodate inward flection of said lower end when said cylindrical portion is inserted into said tube so that said rim makes springing contact with said interior surface portion of said tube.

19. The apparatus of claim 2 wherein said plastic container is made of polypropylene.

20. A metallurgical bond between an exterior surface portion of a metal tube and a surrounding surface portion of a bore in a metal tubesheet, said bore being separated from an adjacent bore in said tubesheet by a ligament portion of said tubesheet, said ligament portion having a transverse dimension less than a transverse dimension of either bore, said bond being formed by detonation of an explosive bonding charge so as to cause said exterior surface portion of said tube to impact upon said surrounding surface portion of said bore with sufficient kinetic energy to result in material from said tube crystallographically interpenetrating material from said tubesheet, said bond extending from within said tubesheet to a front face of said tubesheet, said bond being strongest immediately adjacent said front face of said tubesheet.

21. An explosive package for use in bonding an exterior surface portion of a metal tube to a surrounding surface portion of a bore in a metal tubesheet, said bore being configured so that said surrounding surface portion of said bore is spaced apart from said tube adjacent a front face of said tubesheet and so that said tube has a clearance fit within said bore adjacent a rear face of said tubesheet when said tube is positioned in said bore, said explosive package comprising:

(a) a cup structure configured to receive a bonding charge; and (b) a header structure configured to receive a transfer charge, said header structure being further configured for insertion into said cup structure so that a bottom portion of said header structure shapes said bonding charge within said cup structure and maintains said transfer charge in contact with said bonding charge, said bottom portion of said header structure being predominantly non-perpendicular to said surface portion of said bore, said transfer charge being used in initiating detonation of said bonding charge;

said explosive package being insertable into said tube so that a spacer portion of said cup structure abuts said front face of said tubesheet, said bonding charge thereby being positioned preponderantly below said front face of said tubesheet so as to cause a metallurgical bond to be formed between said exterior surface portion of said tube and said surrounding surface portion of said bore upon detonation of said bonding charge, said metallurgical bond being strongest adjacent said front face of said tubesheet.

22. The explosive package of claim 21 wherein said cup structure comprises:

(a) a hollow cylindrical portion dimensioned for insertion into said tube;

(b) a closure portion extending across said cylindrical portion to form a receptacle region within said cylindrical portion, said bonding charge being received in said receptacle region;

(c) a flange portion extending outwardly from said cylindrical portion; and (d) said spacer portion connected to said flange portion, said spacer portion abutting against said front face of said tubesheet when said cylindrical portion is inserted into said tube, said spacer portion thereby locating said closure portion relative to said front face of said tubesheet so that said bonding charge is positioned for making said bond strongest adjacent said front face of said tubesheet.

23. The explosive package of claim 22 wherein a lower end of said cylindrical portion extends below said closure portion, said lower end of said cylindrical portion being configured to make springing contact with said tube when said cylindrical portion is inserted into said tube.

24. The explosive package of claim 23 wherein said lower end of said cylindrical portion has a rim extending transversely outward, with longitudinally extending slots being provided in said cylindrical portion at said lower end to accommodate inward flection of said lower end when said cylindrical portion is inserted into said tube so that said rim makes springing contact with said tube.

25. The explosive package of claim 22 wherein said flange portion is connected to said cylindrical portion at an upper end of said cylindrical portion, said flange portion spanning a gap between said cylindrical portion and said spacer portion.

26. The explosive package of claim 25 wherein said spacer portion is of hollow elongate configuration, said spacer portion being generally coaxial with respect to said cylindrical portion, a lower end of said spacer portion abutting against said front face of said tubesheet when said cylindrical portion is inserted into said tube.

27. The explosive package of claim 26 wherein said flange portion is connected to said spacer portion between an upper end and said lower end of said spacer portion, said flange portion thereby being spaced apart from said front face of said tubesheet when said cylindrical portion is inserted into said tube.

28. The explosive package of claim 25 wherein said header structure comprises:

(a) an outer cylindrical wall portion dimensioned for insertion with a clearance fit into said cylindrical portion of said cup structure;

(b) an inner hollow cylindrical portion defining an elongate region in which said transfer charge is contained, said elongate region being in communication with said receptacle region so that said transfer charge is in contact with said bonding charge;

(c) said bottom portion extending from said inner cylindrical portion to said outer cylindrical wall portion, said bottom portion overlying said bonding charge; and (d) a flange portion extending outwardly from said outer cylindrical wall portion, said flange portion being dimensioned to overlie said flange portion of said cup structure when said outer cylindrical wall portion is inserted into said cylindrical portion of said cup structure.

29. The explosive package of claim 28 wherein said flange portion of said cup structure extends transversely outward from said cylindrical portion of said cup structure and said flange portion of said header structure extends transversely outward from said outer cylindrical wall portion of said header structure, said flange portion of said header structure being sealed to said flange portion of said cup structure.

30. The explosive package of claim 28 wherein said cylindrical portion of said cup structure and said outer cylindrical wall portion of said header structure are circularly cylindrical.

31. The explosive package of claim 30 wherein said inner cylindrical portion of said header structure defining said elongate region is generally coaxial with said outer cylindrical wall portion of said header structure, said bottom portion of said header structure and said closure portion of said cup structure being configured to provide an axially symmetric distribution of said bonding charge in said receptacle region.

32. The explosive package of claim 31 wherein said closure portion of said cup structure extends transversely across said cylindrical portion of said cup structure, and wherein said bottom portion of said header structure extends as an inverted truncated cone from said inner cylindrical portion to said outer cylindrical wall portion of said header structure.

33. The explosive package of claim 28 wherein an upper end of said inner cylindrical portion of said header structure provides access to an interior region that is configured to receive an explosive firing charge, said interior upper end region being in communication with said elongate region so that said firing charge is contact with said transfer charge, said firing charge being used in initiating detonation of said transfer charge.

34. The explosive package of claim 33 further comprising a covering sheet secured transversely across said inner end of said inner cylindrical portion of said header structure, said covering sheet overlying said firing charge.

35. The explosive package of claim 34 wherein said header structure further comprises a grasping means whereby a means for initiating detonation of said firing charge can be secured to said explosive package.

36. The explosive package of claim 35 wherein said grasping means comprises a pair of arms extending from said bottom portion of said header structure generally parallel to said inner cylindrical portion of said header structure, distal ends of said arms being configured to grasp said means for initiating detonation of said firing charge.

37. The explosive package of claim 34 wherein said covering sheet is made of paper.

38. The explosive package of claim 34 wherein said covering sheet is made of a metallic foil.

39. The explosive package of claim 33 wherein said bonding charge, said transfer charge and said firing charge are made of secondary explosive materials.

40. The explosive package of claim 33 wherein said bonding charge consists essentially of nitroguanidine.

41. The explosive package of claim 33 wherein said transfer charge extends from said elongate region of said header structure into said receptacle region of said cup structure, whereby said transfer charge protrudes into said bonding charge.

42. The explosive package of claim 41 wherein said transfer charge extends into said receptacle region to said closure portion of said cup structure.

43. The explosive package of claim 33 wherein said transfer charge consists of a mixture of pentaerythritol tetranitrate and an elastomer.

44. The explosive package of claim 33 wherein said firing charge consists essentially of pentaerythritol tetranitrate.

45. The explosive package of claim 21 wherein said cup structure and said header structure are made of polypropylene.

46. A system for bonding a plurality of metal tubes to a metal tubesheet, each tube being positioned in a corresponding bore of a plurality of bores in said tubesheet, said bonding system comprising:

(a) a plurality of explosive packages, each one of said explosive packages being insertable into a corresponding one of said tubes, each explosive package containing a bonding charge housed in a container, said container being configured to position said bonding charge within said tube adjacent a front face of said tubesheet so that said bonding charge is preponderantly below said front face of said tubesheet, said container also being configured to shape said bonding charge so that a surface of said bonding charge facing outwardly from said tube is generally concave, forces resulting from detonation of said bonding charge as positioned and shaped by said container whereby causing a metallurgical bond to be formed between an exterior surface portion of said tube and a surrounding surface portion of said bore, said container also containing means for initiating detonation of said bonding charge; and (b) means for activating said means for initiating bonding charge detonations in each of said explosive packages, said activating means causing bonding charge detonations in said plurality of tubes to occur in a temporal pattern that precludes simultaneous bonding charge detonations in adjacent tubes of said plurality of tubes.

47. The bonding system of claim 46 wherein said container comprises a cup structure receiving said bonding charge and a header structure containing said means for initiating detonation of said bonding charge, said cup structure having a hollow cylindrical portion dimensioned for insertion into said tube and a closure portion extending across said cylindrical portion to form a receptacle region for said bonding charge, said cup structure also having a flange portion extending outwardly from said cylindrical portion and a spacer portion connected to said flange portion, said spacer portion abutting against said front face of said tubesheet when said cylindrical portion is inserted into said tube, said spacer portion thereby locating said closure portion relative to said front face of said tubesheet so that said bonding charge is positioned adjacent said front face of said tubesheet, said header structure overlying said bonding charge and being sealed to said cup structure.

48. The bonding system of claim 47 wherein said flange portion of said cup structure is connected to an upper end of said cylindrical portion of said cup structure, said flange portion of said cup structure spanning a gap between said cylindrical portion of said cup structure and said spacer portion of said cup structure.

49. The bonding system of claim 48 wherein said spacer portion of said cup structure is of hollow elongate configuration, said spacer portion being generally coaxial with respect to said cylindrical portion of said cup structure, a lower end of said spacer portion abutting against said front face of said tubesheet when said cylindrical portion is inserted into said tube.

50. The bonding system of claim 49 wherein a lower end of said cylindrical portion of said cup structure extends below said closure portion of said cup structure, said lower end of said cylindrical portion being configured to make springing contact with an interior surface portion of said tube when said cylindrical portion is inserted into said tube.

51. The bonding system of claim 50 wherein said lower end of said cylindrical portion of said cup structure has a rim extending transversely outward, with longitudinally extending slots being provided in said cylindrical portion at said lower end to accommodate inward flection of said lower end when said cylindrical portion is inserted into said tube so that said rim makes springing contact with said interior surface portion of said tube.

52. The bonding system of claim 49 wherein said flange portion of said cup structure is connected to said spacer portion of said cup structure between an upper end and said lower end of said spacer portion, said flange portion of said cup structure thereby being spaced apart from said front face of said tubesheet when said cylindrical portion of said cup structure is inserted into said tube.

53. The bonding system of claim 47 wherein said header structure comprises an outer cylindrical wall portion dimensioned for insertion with a clearance fit into said cylindrical portion of said cup structure, an inner hollow cylindrical portion defining an elongate region in which said means for initiating detonation of said bonding charge is contained, a bottom portion extending from said inner cylindrical portion to said outer cylindrical wall portion of said header structure, said bottom portion of said header structure overlying said bonding charge, and a flange portion extending outwardly from said outer cylindrical wall portion, and flange portion of said header structure being sealed to said cup structure.

54. The bonding system of claim 53 wherein said flange portion of said header structure is dimensioned to overlie said flange portion of said cup structure, said flange portion of said header structure being sealed to said flange portion of said cup structure.

55. The bonding system of claim 53 wherein said inner cylindrical portion of said header structure defining said elongate region is generally coaxial with said outer cylindrical wall portion of said header structure, said bottom portion of said header structure and said closure portion of said cup structure being configured to provide an axially symmetric distribution of said bonding charge in said receptacle region.

56. The bonding system of claim 55 wherein said closure portion of said cup structure extends transversely across said cylindrical portion of said cup structure, and wherein said bottom portion of said header structure extends as an inverted truncated cone from said inner cylindrical portion of said header structure to said outer cylindrical wall portion of said header structure.

57. The bonding system of claim 55 wherein said means for initiating detonation of said bonding charge comprises an explosive transfer charge contained within said elongate region defined by said inner cylindrical portion of said header structure, said elongate region being in communication with said receptacle region so that said transfer charge is in contact with said bonding charge.

58. The bonding system of claim 57 wherein an upper end of said inner cylindrical portion of said header structure provides access to an interior region that is configured to receive an explosive firing charge, said interior upper end region being in communication with said elongate region so that said firing charge is in contact with said transfer charge, said firing charge being used in initiating detonation of said transfer charge.

59. The bonding system of claim 58 further comprising a covering sheet secured transversely across said upper end of said inner cylindrical portion of said header structure, said covering sheet overlying said firing charge.

60. The bonding system of claim 58 wherein said firing charge consists essentially of pentaerythritol tetranitrate.

61. The bonding system of claim 57 wherein said transfer charge consists of a mixture of pentaerythritol tetranitrate and an elastomer.

62. The bonding system of claim 46 wherein said means for initiating bonding charge detonations in said explosive packages comprises a plurality of firing rails, a first one of said firing rails being attached to explosive packages inserted into tubes positioned in a first array of bores in said tubesheet, a second one of said firing rails being attached to explosive packages inserted into tubes positioned in a second array of bores in said tubesheet, a first explosive linear charge being secured to said first firing rail and a second explosive linear charge being secured to said second firing rail, said first linear charge being positioned by said first firing rail to activate means for initiating bonding charge detonations in the explosive packages inserted into tubes positioned in said first array of bores, said second linear charge being positioned by said second firing rail to activate means for initiating bonding charge detonations in the explosive packages inserted into tubes positioned in said second array of bores, activation of said bonding charge detonation initiating means in the tubes in said first array of bores occurring in succession as detonation of said first linear charge progresses temporally along said first linear charge, and activation of said bonding charge detonation initiating means in the tubes in said second array of bores occurring in succession as detonation of said second linear charge progresses temporally along said second linear charge.

63. The bonding system of claim 62 further comprising means for initiating detonation of said first and second linear charges at different times.

64. The bonding system of claim 63 wherein said first firing rail is attached to explosive packages inserted into tubes positioned in a first linear array of bores and said second firing rail is attached to explosive packages inserted into tubes positioned in a second linear array of bores, the bores of said first linear array being adjacent the bores of said second linear array, and wherein said means for initiating detonations of said first and second linear charges comprises an initiation rail crossing said first and second firing rails, an explosive linear initiation charge being secured to said initiation rail, said linear initiation charge being positioned by said initiation rail to activate means for initiating detonations of said first and second linear charges in succession as detonation of said linear initiation charge progresses temporally along said linear initiation charge.

65. The bonding system of claim 64 wherein said linear initiation charge consists of a mixture of pentaerythritol tetranitrate and an elastomer.

66. The bonding system of claim 62 wherein said first and second linear charges consist of a mixture of pentaerythritol tetranitrate and an elastomer.

67. The bonding system of claim 46 wherein said container is made of polypropylene.

68. The bonding system of claim 46 wherein said bonding charge consists essentially of nitroguanidine.

69. A method for bonding a plurality of metal tubes to a metal tubesheet, each tube being positioned in a corresponding bore of a plurality of bores in said tubesheet, said method comprising the steps of:

(a) inserting a corresponding explosive package of a plurality of explosive packages into each tube, each explosive package containing a bonding charge housed in a container, said container being configured to position said bonding charge within said tube adjacent a front face of said tubesheet so that said bonding charge is preponderantly below said front face of said tubesheet, said container also being configured to shape said bonding charge so that a surface of said bonding charge facing outwardly from said tube is generally concave, forces resulting from detonation of said bonding charge thereby causing a metallurgical bond to be formed between an exterior surface portion of said tube and a surrounding surface portion of said corresponding bore; and (b) initiating detonation of said bonding charges in said explosive packages, said bonding charge detonations occurring in said plurality of tubes in a temporal pattern that precludes simultaneous bonding charge detonations in adjacent tubes of said plurality of tubes.

70. The method of claim 69 wherein detonation of said bonding charges in said explosive packages is initiated by:

(a) attaching a first firing rail to explosive packages inserted into tubes positioned in a first array of bores in said tubesheet, a first explosive linear charge being secured to said first firing rail, said first linear charge being positioned by said first firing rail to activate means for initiating bonding charge detonations in the explosive packages inserted into tubes positioned in said first array of bores, activation of said bonding charge detonation initiating means in the tubes in said first array of bores occurring in succession as detonation of said first linear charge progresses temporally along said first linear charge; and (b) attaching a second firing rail to explosive packages inserted into tubes positioned in a second array of bores in said tubesheet, a second explosive linear charge being secured to said second firing rail, said second linear charge being positioned by said second firing rail to activate means for initiating bonding charge detonations in the explosive packages inserted into tubes positioned in said second array of bores, activation of said bonding charge detonation initiating means in the tubes in said second array of bores occurring in succession as detonation of said second linear charge progresses temporally along said second linear charge.

71. The method of claim 70 wherein detonations of said first and second linear charges are initiated at different times.

72. The method of claim 71 wherein detonations of said first and second linear charges are initiated by:

(a) attaching an initiation rail to said first and second firing rails, an explosive linear initiation charge being secured to said initiation rail, said linear initiation charge being positioned by said initiation rail to activate means for initiating detonations of said first and second linear charges in succession as detonation of said linear initiation charge progresses temporally along said linear initiation charge; and (b) initiating detonation of said linear initiation charge.

73. A heat exchanger comprising a plurality of metal tubes and a metal tubesheet, each tube being positioned in a corresponding bore of a plurality of bores in said tubesheet, each bore being separated from an adjacent bore by a corresponding ligament portion of said tubesheet, said ligament portion having a transverse dimension less than a transverse dimension of said bore and of said adjacent bore, an exterior surface portion of said tube being joined to a surrounding surface portion of said corresponding bore by a metallurgical bond, said bond being formed by detonation of an explosive bonding charge so as to cause said exterior surface portion of said tube to impact upon said surrounding surface portion of said bore with sufficient kinetic energy to result in material from said tube crystallographically interpenetrating material from said tubesheet, said bond extending from within said tubesheet to a front face of said tubesheet, said bond being strongest adjacent said front face of said tubesheet.

74. A heat exchanger comprising a plurality of metal tubes bonded to a metal tubesheet, each tube of said plurality of tubes being positioned in a corresponding bore of a plurality of bores in said tubesheet, said bond consisting of material from said tube crystallographically interpenetrating material from said tubesheet, said heat exchanger being produced by a process that comprises:

(a) inserting a corresponding explosive package of a plurality of explosive packages into each tube of said plurality of tubes, said corresponding explosive package comprising a bonding charge housed in a container, said container being configured to position said bonding charge within said tube preponderantly below said front face of said tubesheet, said container also being configured to shape said bonding charge so that a surface of said bonding charge facing outwardly from said tube is generally concave, forces resulting from detonation of said bonding charge thereby causing said bond to be formed; and (b) initiating detonations of bonding charges contained in said plurality of explosive packages inserted in said plurality of tubes, said bonding charge detonations occurring in a temporal pattern that precludes simultaneous bonding charge detonations in adjacent tubes for said plurality of tubes.

75. The heat exchanger of claim 74 wherein detonations of said bonding charges in said explosive packages are initiated by:

(a) attaching a first firing rail to explosive packages inserted into tubes positioned in a first array of bores in said tubesheet, a first explosive linear charge being secured to said first firing rail, said first linear charge being positioned by said first firing rail to activate means for initiating bonding charge detonations in the explosive packages inserted into tubes positioned in said first array of bores, activation of said bonding charge detonation initiating means in the tubes in said first array of bores occurring in succession as detonation of said first linear charge progresses temporally along said first linear charge; and (b) attaching a second firing rail to explosive packages inserted into tubes positioned in a second array of bores in said tubesheet, a second explosive linear charge being secured to said second firing rail, said second linear charge being positioned by said second firing rail to activate means for initiating bonding charge detonations in the explosive packages inserted into tubes positioned in said second array of bores, activation of said bonding charge detonation initiating means in the tubes in said second array of bores occurring in succession as detonation of said second linear charge progresses temporally along said second linear charge.

76. The heat exchanger of claim 75 wherein detonations of said first and second linear charges are initiated at different times.

77. The heat exchanger of claim 76 wherein detonations of said first and second linear charges are initiated by:

(a) attaching an initiation rail to said first and second firing rails, an explosive linear initiation charge being secured to said initiation rail, said linear initiation charge being positioned by said initiation rail to activate means for initiating detonations of said first and second linear charges in succession as detonation of said linear initiation charge progresses temporally along said linear initiation charge; and (b) initiating detonation of said linear initiation charge.

78. A method for bonding each tube of a plurality of metal tubes to a corresponding bore of a plurality of bores in a metal tubesheet, said bores being disposed in said tubesheet in parallel linear arrays, a bore of a first linear array being adjacent at least one bore of a second linear array, said method comprising the steps of:

(a) positioning a first set of said tubes in said first linear array of bores, each tube of said first set of tubes being positioned in a corresponding bore of said first linear array of bores;

(b) inserting a first set of explosive packages of a plurality of explosive packages into said first set of tubes, each explosive package including a container that houses a bonding charge, said container being configured for insertion into one of said tubes positioned in a corresponding one of said bores so as to position said bonding charge adjacent a front face of said tubesheet, whereby detonation of said bonding charge causes bonding of an exterior surface portion of said tube to a surrounding surface portion of said corresponding bore;

(c) inserting first plug means into said second linear array of bores, said first plug means bracing the surrounding surface portion of each bore of said second linear array against movement in reaction to a bonding charge detonation in a tube of said first set of tubes positioned in an adjacent bore of said first linear array of bores;

(d) initiating sequential bonding charge detonations in said first set of tubes to cause bonding of the exterior surface portion of each tube of said first set of tubes to the surrounding surface portion of each corresponding bore of said first linear array of bores;

(e) removing said first plug means from said second linear array of bores after said exterior surface portion of each tube of said first set of tubes has been bonded to said surrounding surface portion of each corresponding bore of said first linear array of bores;

(f) positioning a second set of said tubes in said second linear array of bores, each tube of said second set of tubes being positioned in a corresponding bore of said second linear array of bores;

(g) inserting a second set of explosive packages of said plurality of explosive packages into said second set of tubes;

(h) inserting second plug means into said first set of tubes bonded to said corresponding bores of said first linear array, said second plug means bracing each tube of said first set of tubes against movement in reaction to a bonding charge detonation in a tube of said second set of tubes positioned in an adjacent bore of said second linear array of bores; and (i) initiating sequential bonding charge detonations in said second set of tubes to cause bonding of the exterior surface portion of each tube of said second set of tubes to the surrounding surface portion of each corresponding bore of said second linear array of bores.

79. The method of claim 78 wherein the step of inserting said first plug means into said second linear array of bores comprises inserting a corresponding one of a plurality of resilient plugs into each bore of said second linear array.

80. The method of claim 79 wherein the inserting of said resilient plug of said first plug means into said corresponding bore of said second linear array comprises compressing said resilient plug of said first plug means so as to bear against a surface portion of said corresponding bore of said second linear array.

81. The method of claim 78 wherein the step of inserting said second plug means into said first set of tubes comprises inserting one of a plurality of plugs into each corresponding tube of said first set of tubes bonded to said corresponding bore of said first linear array.

82. The method of claim 78 wherein sequential bonding charge detonations in said first set of tubes are initiated by attaching a first firing rail to said first set of explosive packages inserted into said first set of tubes, a first linear charge being secured to said first firing rail, said first linear charge being positioned by said first firing rail to that detonation of said first linear charge causes activation of means in each of said first set of explosive packages for detonating the bonding charges in said first set of explosive packages in sequence.

83. The method of claim 82 wherein detonation of said first linear charge is initiated by attaching a first initiation rail to said first firing rail, a first linear initiation charge being secured to said first initiation rail, said first linear initiation charge being positioned by said first initiation rail so that detonation of said first linear initiation charge causes activation of means for initiating detonation of said first linear charge secured to said first firing rail.

84. The method of claim 78 wherein sequential bonding charge detonations in said second set of tubes are initiated by attaching a second firing rail to said second set of explosive packages inserted into said second set of tubes, a second linear charge being secured to said second firing rail, said second linear charge being positioned by said second firing rail so that detonation of said second linear charge causes activation of means in each of said second set of explosive packages for detonating the bonding charges in said second set of explosive packages in sequence.

85. The method of claim 84 wherein detonation of said second linear charge is initiated by attaching a second initiation rail to said second firing rail, a second linear initiation charge being secured to said second initiation rail, said second linear initiation charge being positioned by said second initiation rail so that detonation of said second linear initiation charge causes activation of means for initiating detonation of said second linear charge secured to said second firing rail.

86. A system for bonding each tube of a plurality of metal tubes to a corresponding bore of a plurality of bores in a metal tubesheet, said bores being disposed in said tubesheet in parallel linear arrays, a bore of a first linear array being adjacent at least one bore of a second linear array, said bonding system comprising:

(a) a plurality of explosive packages, each one of said explosive packages being insertable into a corresponding one of said tubes, each explosive package including a bonding charge housed in a container, said container being configured to position said bonding charge within the corresponding one of said tubes adjacent a front face of said tubesheet when said corresponding one of said tubes is positioned in a corresponding one of said bores, said container also containing means for initiating detonation of said bonding charge;

(b) first firing rail means for sequentially activating the means for initiating detonations of bonding charges in explosive packages of a first set of said explosive packages when the explosive packages of said first set of explosive packages are inserted into adjacent tubes of a first set of said tubes, said first set of said tubes being positioned in adjacent bores of said first linear array of said bores;

(c) first plug means for insertion into said second linear array of said bores when said first set of said explosive packages has been inserted into said first set of said tubes, said first plug means bracing surface portions of the bores of said second linear array of said bores against movement in reaction to bonding charge detonations in the tubes of said first set of said tubes positioned in said first linear array of said bores;

(d) second firing rail means for sequentially activating the means for initiating detonations of bonding charges in the explosive packages of a second set of said explosive packages when the explosive packages of said second set of explosive packages are inserted into adjacent tubes of a second set of said tubes, said second set of said tubes being positioned in adjacent bores of said second linear array of said bores after said first plug means has been removed from said second linear array of said bores following bonding charge detonations in said first set of said tubes; and (e) second plug means for insertion into said first set of tubes bonded to corresponding bores of said first linear array of said bores when said second set of said explosive packages has been inserted into said second set of said tubes following bonding of an exterior surface portion of each tube of said first set of said tubes to a surrounding surface portion of a corresponding bore of said first linear array of said bores, said second plug means bracing said first set of said tubes against movement in reaction to bonding charge detonations in the tubes of said second set of said tubes;

said first firing rail, first plug means, second firing rail and second plug means cooperating to prevent significant spalling of ligaments between adjacent bores in different linear arrays of said bores.

87. The bonding system of claim 86 wherein said first firing rail means comprises a first linear charge secured to an elongate first firing rail, said first firing rail being secured to each explosive package of said first set of said explosive packages, said first linear charge being detonatable in a temporal progression so that bonding charge detonations in said first set of explosive packages can be initiated sequentially.

88. The bonding system of claim 86 wherein said second firing rail means comprises a second linear charge secured to an elongate second firing rail, said second firing rail being secured to each explosive package of said second set of said explosive packages, said second linear charge being detonatable in a temporal progression so that bonding charge detonations in said second set of explosive packages can be initiated sequentially.

89. The bonding system of claim 86 wherein said bonding charge container of each explosive package comprises a spacer portion that abuts against said front face of said tubesheet when said explosive package is inserted into said corresponding tube, said spacer portion having a generally hexagonal configuration.

90. The bonding system of claim 89 wherein said first plug means comprises a plurality of plugs, each plug of said first plug means being insertable into a corresponding bore of said second linear array of said bores so that a top portion of each plug abuts against said front face of said tubesheet, said top portion of each plug having a generally hexagonal configuration, the top portions of the plugs of said first plug means when inserted into the corresponding bores of said second linear array of said bores thereby nesting with respect to each other and with respect to the spacer portions of the bonding charge containers of the explosive packages inserted into said first set of tubes positioned in said first linear array of said bores, whereby a protective covering for said front face of said tubesheet is formed.

91. The bonding system of claim 89 wherein said second plug means comprises a plurality of plugs, each plug of said second plug means being insertable into a corresponding tube of said first set of tubes bonded to a corresponding bore of said first linear array of said bores so that a top portion of each plug abuts against said front face of said tubesheet, said top portion of each plug having a generally hexagonal configuration, the top portions of the plugs of said second plug means when inserted into the corresponding tubes of said first set of tubes in said first linear array of said bores thereby nesting with respect to each other and with respect to the spacer portions of the bonding charge containers of the explosive packages inserted into said second set of tubes positioned in said second linear array of said bores, whereby a protective covering for said front face of said tubesheet is formed.

92. An explosive package for bonding an exterior surface portion of a metal tube to a surrounding surface portion of a bore in a metal tubesheet, said surrounding surface portion of said bore being spaced apart from said tube adjacent a front face of said tubesheet, said explosive package comprising a cup structure containing a bonding charge, said cup structure being configured for insertion into said tube to position said bonding charge so that detonation of said bonding charge causes a metallurgical bond to be formed between said exterior surface portion of said tube and said surrounding surface portion of said bore, said explosive package further comprising a header structure containing a transfer charge and a firing charge, said firing charge being in contact with said transfer charge so that detonation of said firing charge initiates detonation of said transfer charge, said header structure being configured for insertion into said cup structure over said bonding charge to position said transfer charge in contact with said bonding charge so that detonation of said transfer charge initiates detonation of said bonding charge, said header structure comprising a pair of arms configured for grasping a firing rail means for initiating detonation of said firing charge.

93. The explosive package of claim 92 wherein said cup structure is configured to define a generally cylindrical receptical region for receiving said bonding charge, and wherein said header structure comprises an outer cylindrical wall portion and and an inner cylindrical wall portion, said outer and inner cylindrical wall portions being joined by a bottom portion, said bottom portion of said header structure being positioned over said bonding charge when said header structure is inserted into said cup structure, said inner cylindrical wall portion of said header structure defining a hollow elongate region in which said transfer charge is contained in contact with said bonding charge and in which said firing charge is contained in contact with said transfer charge.

94. The explosive package of claim 93 in which said pair of arms for grasping said firing rail means extends from said bottom portion of said header structure generally parallel to said inner cylindrical portion of said header structure.

95. A protective covering for a front face of a metal tubesheet, said protective covering comprising a plurality of plugs, said plugs being interchangeable with each other, each one of said plugs being insertable into a corresponding bore of a first plurality of bores in said tubesheet as a brace during detonation of a bonding charge in an adjacent bore of a second plurality of bores in said tubesheet, a top portion of each one of said plugs overlapping a corresponding area on the front face of said tubesheet when said plug is inserted into said corresponding bore in said tubesheet, the top portions of all of said plugs being substantially identically configured, the top portion of each one of said plugs being in extended contact with the top portion of another one of said plugs when all of said plugs are inserted into the corresponding bores of said first plurality of bores in said tubesheet, the top portions of all of said plugs collectively covering all otherwise exposed areas on the front face of said tubesheet during detonation of bonding charges in adjacent bores of said second plurality of bores in said tubesheet, said top portions of said plugs thereby protecting the front face of said tubesheet from damage due to detonation of said bonding charges.

96. The protective covering of claim 95 wherein said top portion of each plug has a generally hexagonal configuration.

97. A protective covering for a front face of a metal tubesheet, said protective covering comprising a plurality of plugs, said plugs being interchangeable with each other, each plug including:

(a) a supporting structure comprising a rigid base plate and an elongate member extending generally perpendicularly from said base plate, a proximal end of said elongate member being secured to said base plate and a distal end of said elongate member being screw-threaded;

(b) a resilient member of generally circularly cylindrical configuration, said resilient member having an axial bore therethrough, said bore of said resilient member activating said elongate member of said supporting structure;

(c) a rigid top plate having a bore therethrough, said bore of said top plate receiving said elongate member of said supporting structure; and (d) a nut threadably securable to said distal end of said elongate member of said supporting structure when said resilient member is sandwiched between said base plate of said supporting structure and said top plate;

each plug being insertable into a corresponding metal tube bonded by a metallurgical bond to a surface portion of said corresponding bore in said tubesheet to protect said bond by bracing said tube against movement relative to said corresponding bore in reaction to detonation of a bonding charge in an adjacent bore in said tubesheet, said top plate of each plug overlapping said front face of said tubesheet when each plug is inserted into said corresponding tube bonded to said corresponding bore in said tubesheet, top plates of all of said plugs being substantially identically configured, the top plate of each plug being in extended contact with the top plate of at least one other of said plugs when all of said plugs are inserted into corresponding tubes bonded to corresponding bores in said tubesheet, the top plates of all of said plugs collectively covering all otherwise exposed areas on said front face of said tubesheet during detonation of bonding charges in adjacent bores in said tubesheet, said top plates of said plurality of plugs thereby protecting said front face of said tubesheet from damage due to detonation of said bonding charges.

98. The protective covering of claim 97 wherein said top plate of each plug has a generally hexagonal configuration.

* * * * *